US010574015B1

(12) United States Patent
Dix et al.

(10) Patent No.: US 10,574,015 B1
(45) Date of Patent: Feb. 25, 2020

(54) TERMINAL ASSEMBLY AND METHOD

(71) Applicant: Lear Corporation, Southfield, MI (US)

(72) Inventors: Brandon H. Dix, Livonia, MI (US); Salim A. Marouf, Ypsilanti, MI (US); Priyal N. Sheth, Dearborn, MI (US); Arindam Banerjee, Dearborn, MI (US); Sneha Agasthya, Dearborn, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/107,445

(22) Filed: Aug. 21, 2018

(51) Int. Cl.

| | |
|---|---|
| ***H01R 4/10*** | (2006.01) |
| ***H01R 43/048*** | (2006.01) |
| ***H01R 43/042*** | (2006.01) |
| *H01R 4/18* | (2006.01) |

(52) U.S. Cl.
CPC ..... *H01R 43/048* (2013.01); *H01R 43/042* (2013.01); *H01R 4/184* (2013.01)

(58) Field of Classification Search
CPC ..... H01R 43/042; H01R 43/048; H01R 4/184
USPC ..... 439/877
See application file for complete search history.

(56) References Cited

U.S. PATENT DOCUMENTS

| | | | | |
|---|---|---|---|---|
| 2,157,007 A | | 5/1939 | Offner | |
| 3,510,824 A | | 5/1970 | Corns | |
| 3,875,662 A | | 4/1975 | Folk | |
| 4,142,771 A | * | 3/1979 | Barnes | H01R 4/184 174/84 C |
| 4,246,771 A | | 1/1981 | Covill et al. | |
| 4,831,727 A | * | 5/1989 | Johnson, Jr. | H01R 43/01 29/566.3 |
| 4,890,384 A | | 1/1990 | Shaffer | |
| 5,025,554 A | * | 6/1991 | Dohi | H01R 4/187 29/860 |
| 5,357,669 A | | 10/1994 | Orphanos et al. | |
| 5,486,653 A | | 1/1996 | Dohi | |

(Continued)

FOREIGN PATENT DOCUMENTS

| | | |
|---|---|---|
| JP | 2009021038 A | 1/2009 |
| JP | 2017111883 A | 6/2017 |
| JP | 2017174689 A | 9/2017 |

OTHER PUBLICATIONS

Co-pending U.S. application, Dix, et al., U.S. Appl. No. 16/107,080, filed Aug. 21, 2018.

(Continued)

*Primary Examiner* — Abdullah A Riyami
*Assistant Examiner* — Vladimir Imas
(74) *Attorney, Agent, or Firm* — Fishman Stewart PLLC

(57) ABSTRACT

A method of assembling a terminal assembly includes providing a terminal. The terminal may include a terminal body portion, a first wing, and/or a second wing. A first wing and the second wing may each include an end portion. The method may include bending an end portion of a first wing and/or an end portion of a second wing that may provide a first bent portion and a second bent portion. The method may include crimping the first bent portion and the second bent portion onto a wire. The terminal may be in a first position during bending and/or the terminal may be rotated to a second position after bending. The terminal may be in the second position during crimping. The first position and the second position may be substantially perpendicular.

20 Claims, 15 Drawing Sheets

(56) References Cited

U.S. PATENT DOCUMENTS 5,733,154 A * 3/1998 Libregts ..... H01R 4/182 439/850
6,059,616 A * 5/2000 Bluemmel ..... H01R 4/185 439/867
6,109,088 A 8/2000 Schrader et al.
6,334,798 B1 1/2002 Ushijima et al.
6,989,491 B2 1/2006 Triantopoulos et al.
7,044,813 B2 * 5/2006 Amara ..... H01R 13/41 439/866
7,402,751 B2 7/2008 Haberman
7,775,842 B2 8/2010 Yamagami
7,803,008 B2 9/2010 Onuma
7,828,612 B2 11/2010 Kumakura
8,196,288 B2 6/2012 Wagner et al.
8,210,884 B2 * 7/2012 Corman ..... H01R 4/185 439/877
8,221,171 B2 7/2012 Ono et al.
8,827,754 B2 * 9/2014 Lee ..... H01R 13/113 439/843
8,827,756 B2 * 9/2014 Mueller ..... H01R 13/112 439/852
8,869,584 B2 10/2014 Sokol
8,900,021 B2 * 12/2014 Sulek ..... B23K 1/0008 439/884
9,039,467 B2 * 5/2015 Seipel ..... H01R 4/185 439/877
9,787,003 B2 10/2017 Kamoshida et al.
9,853,368 B2 * 12/2017 Myer ..... H01R 4/185
2005/0257592 A1 11/2005 Baker et al.
2008/0081520 A1 4/2008 Myer et al.
2013/0217279 A1 8/2013 Hemond et al.
2014/0322993 A1 10/2014 Ito
2014/0378011 A1 12/2014 Aizawa et al.
2015/0303603 A1 10/2015 Hemond et al.
2015/0364833 A1 12/2015 Tonoike et al.
2016/0087350 A1 3/2016 Yamaji et al.
2016/0240937 A1 8/2016 Matsuo
2016/0372881 A1 12/2016 Bauer et al.

OTHER PUBLICATIONS

Co-pending U.S. application, Dix, et al., U.S. Appl. No. 16/107,578, filed Aug. 21, 2018.
Co-pending U.S. application, Dix, et al., U.S. Appl. No. 16/107,631, filed Aug. 21, 2018.

* cited by examiner

TERMINAL ASSEMBLY AND METHOD

TECHNICAL FIELD

The present disclosure generally relates to terminals and terminal assemblies, including electrical terminals that may be used in connection with electrical wires or cables.

BACKGROUND

This background description is set forth below for the purpose of providing context only. Therefore, any aspect of this background description, to the extent that it does not otherwise qualify as prior art, is neither expressly nor impliedly admitted as prior art against the instant disclosure.

Some terminal assemblies may be relatively complex to use and/or to assemble. For example, connecting a terminal with some electrical conductors may involve a complex process and may include many different steps and components. Some terminals may not be configured for use with conductors of different sizes, so different types of terminals may be used for various sizes of conductors.

There is a desire for solutions/options that minimize or eliminate one or more challenges or shortcomings of terminals, electrical terminals, and/or terminal assemblies. The foregoing discussion is intended only to illustrate examples of the present field and should not be taken as a disavowal of scope.

SUMMARY

The foregoing and other aspects, features, details, utilities, and/or advantages of embodiments of the present disclosure will be apparent from reading the following description, and from reviewing the accompanying drawings.

In embodiments, a method of assembling a terminal assembly may include providing a terminal. The terminal may include a terminal body portion, a first wing, and/or a second wing. A first wing and a second wing may each include an end portion. The method may include bending an end portion of a first wing and/or an end portion of a second wing, which may provide a first bent portion and a second bent portion. The method may include crimping the first bent portion and the second bent portion onto a wire. In embodiments, a terminal may be in a first position during bending, and/or the terminal may be rotated to a second position after bending. The terminal may be in the second position during crimping. The first position and the second position may be substantially perpendicular relative to each other. Bending the end portion of the first wing and/or bending the end portion of the second wing may include bending the end portion of the first wing and/or the end portion of the second wing via a bending die. Bending may include moving at least a portion of a bending die in a first direction, crimping may include moving at least a portion of a crimping die in a second direction, and/or the first direction and the second direction may be substantially parallel. After crimping, the terminal may include an external recess that may be disposed at a lateral side of the terminal. The external recess may be formed via portions of the first wing and/or the second wing.

With embodiments, a method of assembling a terminal assembly may include providing a terminal including a terminal body, a first wing, and/or a second wing. The first wing and/or the second wing may each include an end portion. The method may include bending the end portion of the first wing from a first direction relative to the terminal, which may provide a first bent portion. The method may include bending the end portion of the second wing from the first direction, which may provide a second bent portion. The method may include crimping the first bent portion and/or the second bent portion with a wire from a second direction relative to the terminal. The first direction may be substantially perpendicular to the second direction. Bending the end portion of the first wing may include a bending die contacting the end portion of the first wing. Bending the end portion of the second wing may include the bending die contacting the end portion of the second wing.

In embodiments, crimping the first bent portion and/or the second bent portion may include a crimp die top portion contacting the first wing and not the second wing. Crimping the first bent portion and/or the second bent portion may include a securing channel of the crimp die bottom portion contacting the second wing and not the first wing. The method may include crimping a third wing and/or a fourth wing of the terminal. The third wing and/or the fourth wing may be crimped from a different direction, relative to the terminal, than the first bent portion and/or the second bent portion. After crimping, the terminal may include a section having at least six overlapping layers. The first wing may include at least three overlapping layers of the at least six overlapping layers, and/or the second wing may include at least three other layers of the at least six overlapping layers.

After crimping, the terminal may include an external recess that may be disposed at a lateral side of the terminal. The external recess may be formed via portion of the first wing and/or the second wing.

With embodiments, an electrical assembly may include an electrical wire and a terminal. The terminal may include a terminal body and/or a plurality of wings. The plurality of wings may include a first wing and/or a second wing. The first wing may include a first bent portion and/or the second wing may include a second bent portion. The first bent portion may be disposed below the second bent portion. At least one of the first bent portion and/or the first wing may be substantially horizontal. At least one of the second bent portion and/or the second wing may be substantially horizontal. In embodiments, at least one of the first bent portion and/or the second bent portion may contact the electrical wire. In embodiments, the electrical assembly may include a third wing and/or a fourth wing. The third wing may include a third bent portion and/or the fourth wing may include a fourth bent portion. The first bent portion and/or the second bent portion may be substantially vertical. The first bent portion and/or the second bent portion may be substantially perpendicular to the third bent portion and/or the fourth bent portion.

DETAILED DESCRIPTION

Figure 1B:
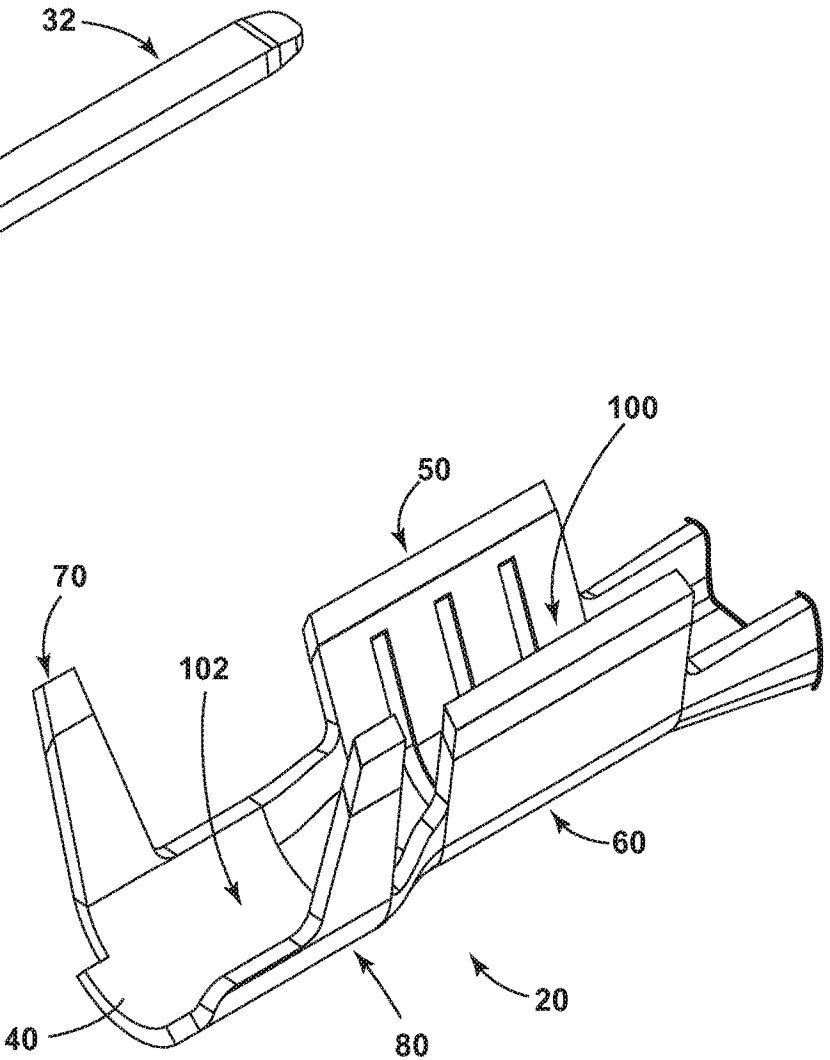
FIG. 1B is a perspective view generally illustrating portions of an embodiment of a terminal.
Figure 1A:
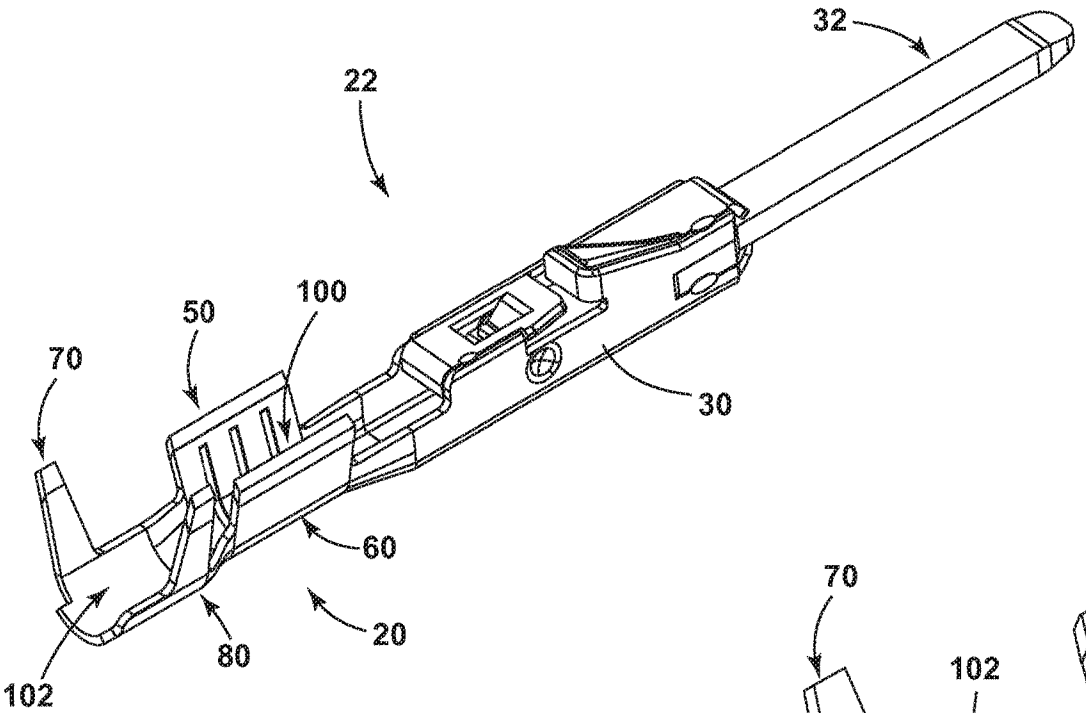
FIG. 1A is a perspective view generally illustrating an embodiment of a terminal assembly.
Figure 1C:
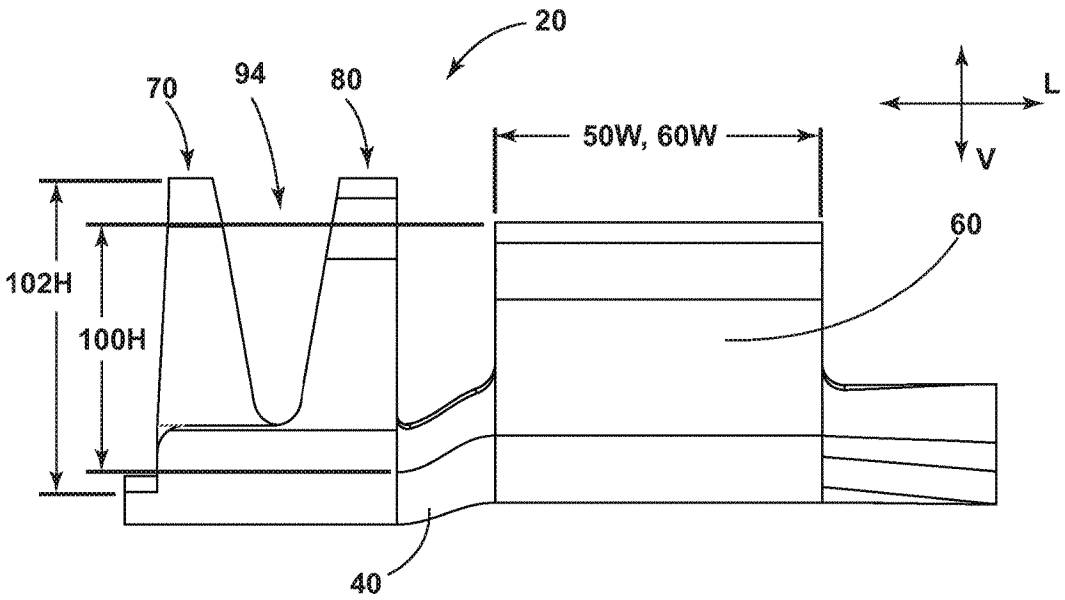
FIG. 1C is a side view generally illustrating portions of an embodiment of a terminal.
Figure 1D:
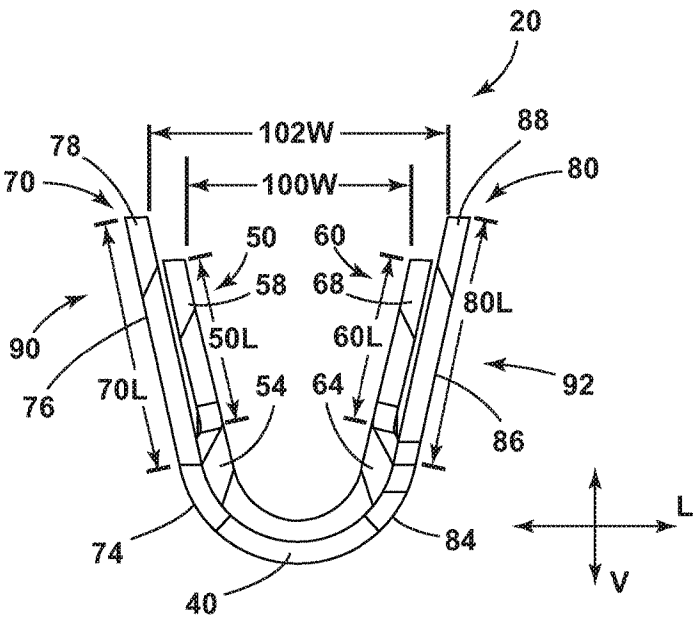
FIG. 1D is a cross-sectional view generally illustrating an embodiment of a terminal.
Figure 1E:
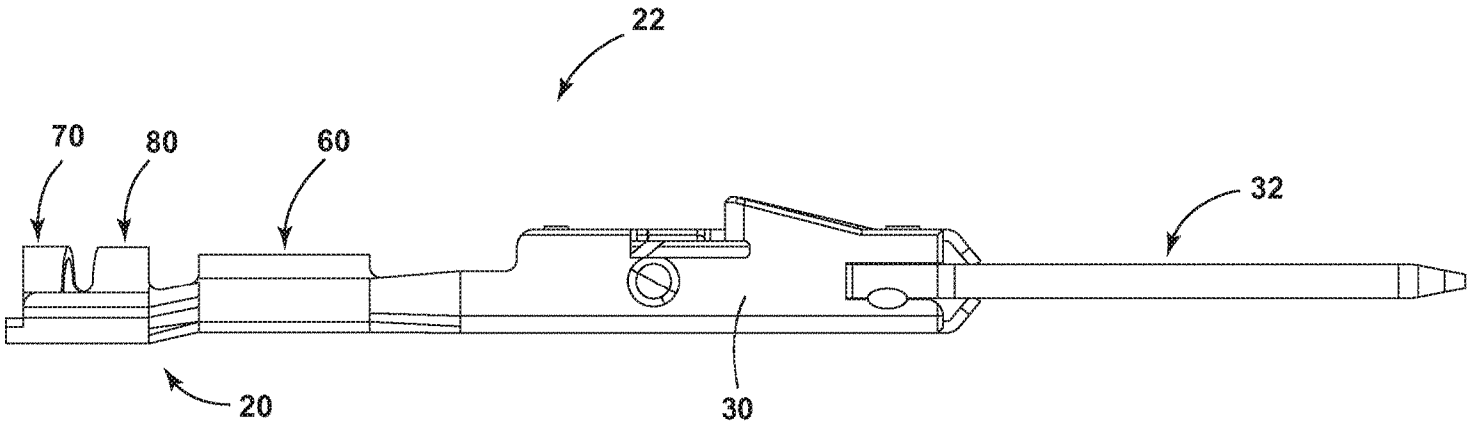
FIG. 1E is a side view generally illustrating an embodiment of a terminal assembly.
Figure 1F:
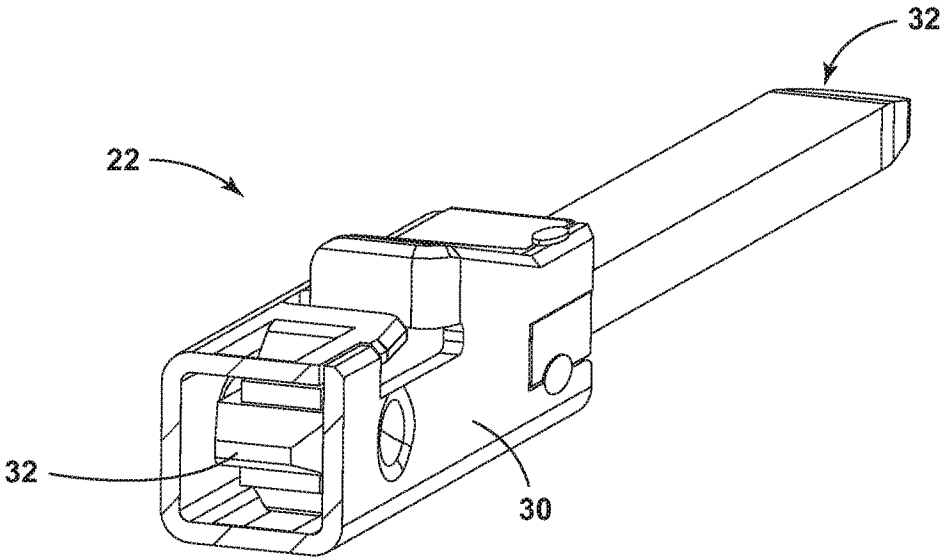
FIG. 1F is a cross-sectional perspective view generally illustrating portions an embodiment of a terminal assembly.

Reference will now be made in detail to embodiments of the present disclosure, examples of which are described herein and illustrated in the accompanying drawings. While the present disclosure will be described in conjunction with embodiments and/or examples, it will be understood that they are not intended to limit the present disclosure to these embodiments and/or examples. On the contrary, the present disclosure is intended to cover alternatives, modifications, and equivalents.

In embodiments, such as generally illustrated in FIGS. 1A, 1B, 1C, 1D, 1E, and 1F, a terminal assembly 22 may include a terminal 20 and a wire 24. The terminal 20 may include and/or be connected to a receiving portion 30. The receiving portion 30 may be configured to receive a male terminal or pin 32. The wire 24 may include a conductor 26 and an insulator 28 (e.g., see FIGS. 9A and 9B). The insulator 28 may be connected and/or at least partially surround the conductor 26. With embodiments, the terminal 20 may be configured to retain a wire 24. The terminal 20 may include a terminal body portion 40, a first wing 50, and/or a second wing 60. A terminal 20 may include one or more of a variety of shapes, sizes, and/or configurations. For example and without limitation, the terminal 20 may be substantially U-shaped and/or V-shaped.

In embodiments, a terminal body portion 40, a first wing 50, and/or a second wing 60 may include respective inner surfaces and outer surfaces. The terminal wings 50, 60 may be substantially planar. With embodiments, the terminal 20 may include a third wing 70 and/or a fourth wing 80. The first wing 50, the second wing 60, the third wing 70, and/or the fourth wing 80 may extend outward (e.g., vertically and/or laterally) from the terminal body portion 40. The first wing 50, the second wing 60, the third wing 70, and/or the fourth wing 80 may or may not extend at substantially the same angle (e.g., oblique and/or right angles) from the terminal body 40. The first wing 50 and the second wing 60 may extend at the same angle in opposite directions relative to the vertical direction.

With embodiments, the first wing 50 and the third wing 70 may extend from a first side 90 of the terminal body portion 40, and/or the second wing 60 and the fourth wing 80 may extend from a second side 92 of the terminal body portion 40. In embodiments, the first wing 50 and the second wing 60 may be disposed opposite each other, and/or the third wing 70 and the fourth wing 80 may be disposed opposite each other. With embodiments, the first wing 50 and the second wing 60 may include lengths 50L, 60L (e.g., from a bottom of the wings to the top of the wings), which may or may not be the same. The third wing 70 and the fourth wing 80 may include lengths 70L, 80L, which may or may not be the same. The lengths 50L, 60L may be different than the lengths 70L, 80L (e.g., shorter or longer). In embodiments, the first wing 50 and the second wing 60 may include widths 50W, 60W (e.g., relative to a longitudinal direction L), which may or may not be the same.

In embodiments, the third wing 70 and/or the fourth wing 80 may be offset, such as in a longitudinal direction (e.g., not disposed directly across from each other). For example and without limitation, the third wing 70 may be disposed farther from the first wing 50 and/or the second wing 60 than the fourth wing 80. With embodiments, there may be a gap 94 (e.g., in the longitudinal direction) between the third wing 70 and the fourth wing 80.

With embodiments, the terminal body portion 40, the first wing 50, and/or the second wing 60 may form a first channel 100. The terminal body portion 40, the third wing 70, and/or the fourth wing 80 may form a second channel 102. With embodiments, the first channel 100 and/or the second channel 102 may be aligned (e.g., aligned in the longitudinal direction and/or the lateral direction). The first wing 50 and the second wing 60 may be configured to retain a conductor 26 of a wire 24. The third wing 70 and the fourth wing 80 may be configured to retain an insulator 28 of a wire 24.

In embodiments, the first channel 100 may include a width 100W and the second channel 102 may include a width 102W (e.g., width in a transverse direction T of the terminal 20). The first channel width 100W may be less than the second channel width 102W. With embodiments, the first channel 100 may include a first height 100H (e.g., in the vertical direction V), and the second channel may include a second height 102H (e.g., in the vertical direction V). The second height 102H may be greater than the first height 100H when measured from the same vertical position of the terminal 20 (e.g., at or about end portions of the wings 50, 60, 70, 80).

Figure 5C:
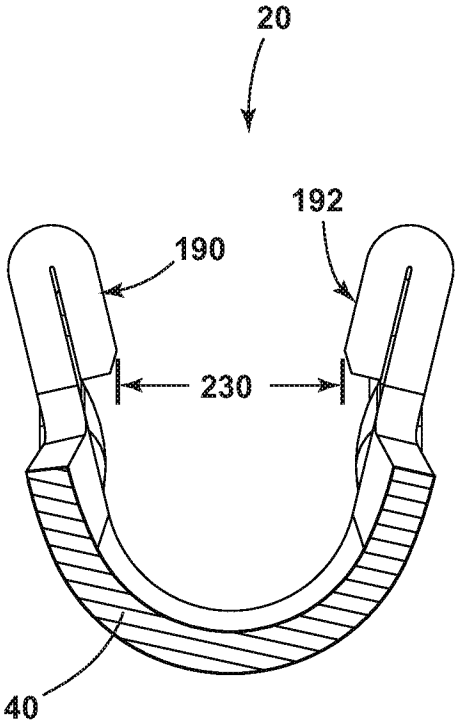
FIGS. 5A, 5B, and 5C are cross-sectional views generally illustrating embodiments of terminals after bending.
Figure 5B:
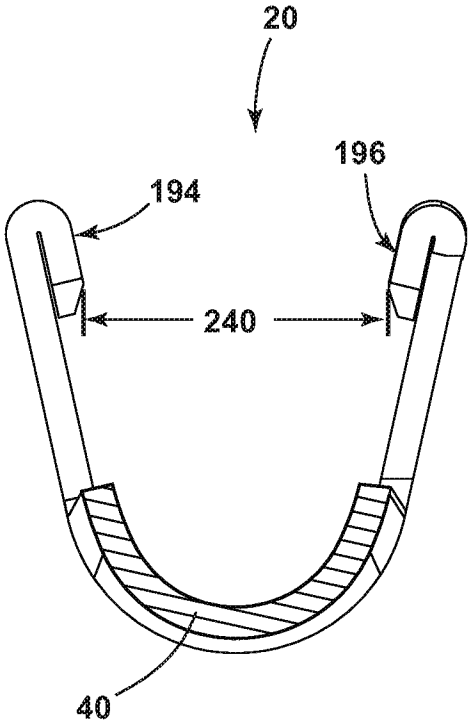
Figure 5A:
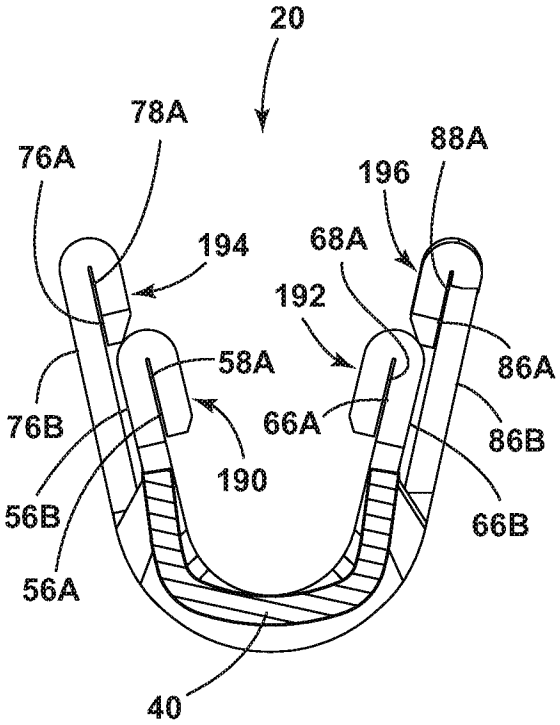
Figure 6B:
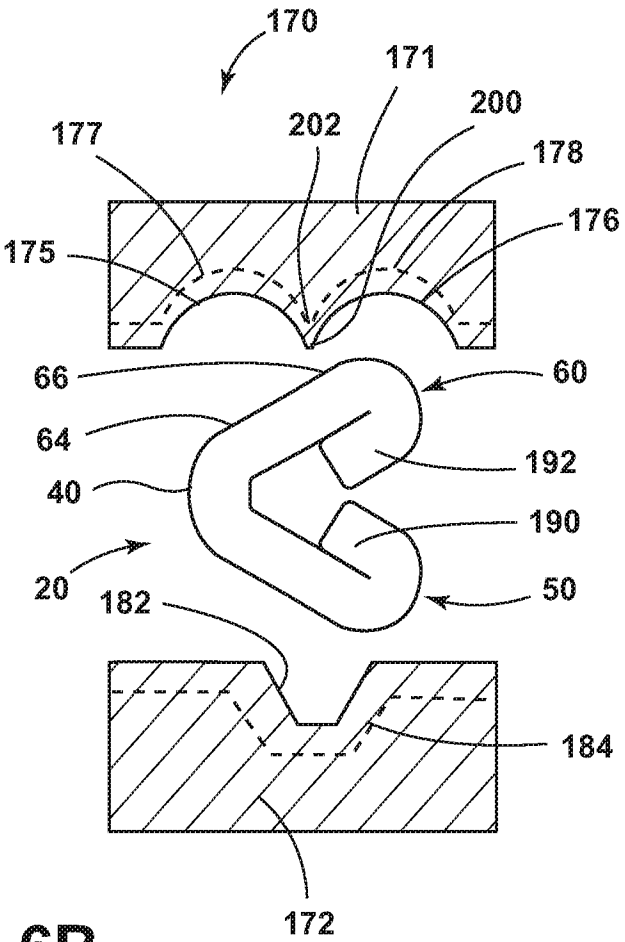
FIGS. 6A and 6B are cross-sectional views generally illustrating portions of embodiments of terminals and dies.
Figure 6A:
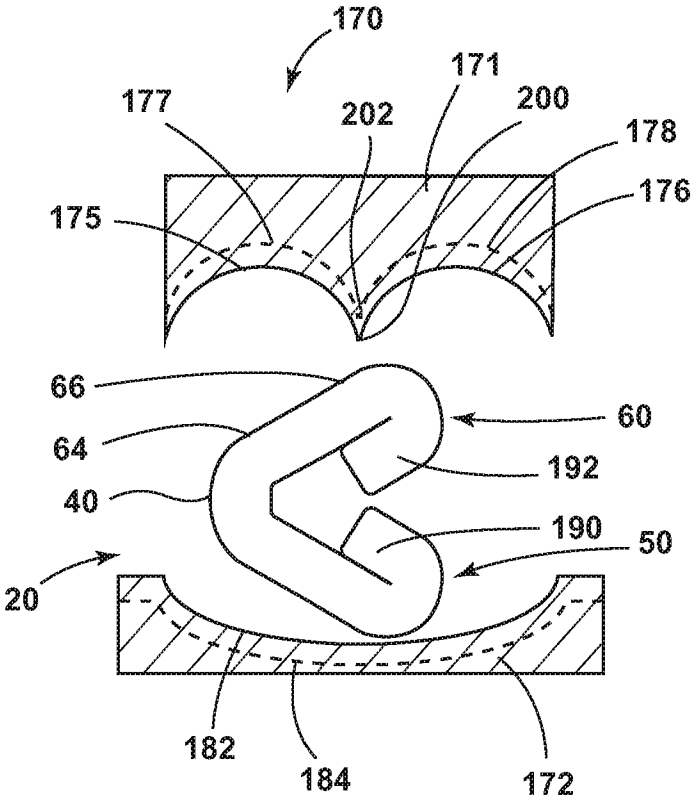

In embodiments, the wings 50, 60, 70, 80 may each include an end portion 58, 68, 78, 88, a middle portion 56, 66, 76, 86, and/or a connecting portion 54, 64, 74, 84. The end portions 58, 68, 78, 88 may include inner surfaces 58A, 68A, 78A, 88A (see, e.g., FIG. 5A). The middle portions may include inner surfaces 56A, 66A, 76A, 86A and/or outer surfaces 56B, 66B, 76B, 86B. The connecting portion 54, 64, 74, 84 may connect the wings 50, 60, 70, 80 to the terminal body 40. The middle portion 56, 66, 76, 86 of the wings 50, 60, 70, 80 may connect the connecting portions 54, 64, 74, 84 to the end portions 58, 68, 78, 88.

Figure 2:
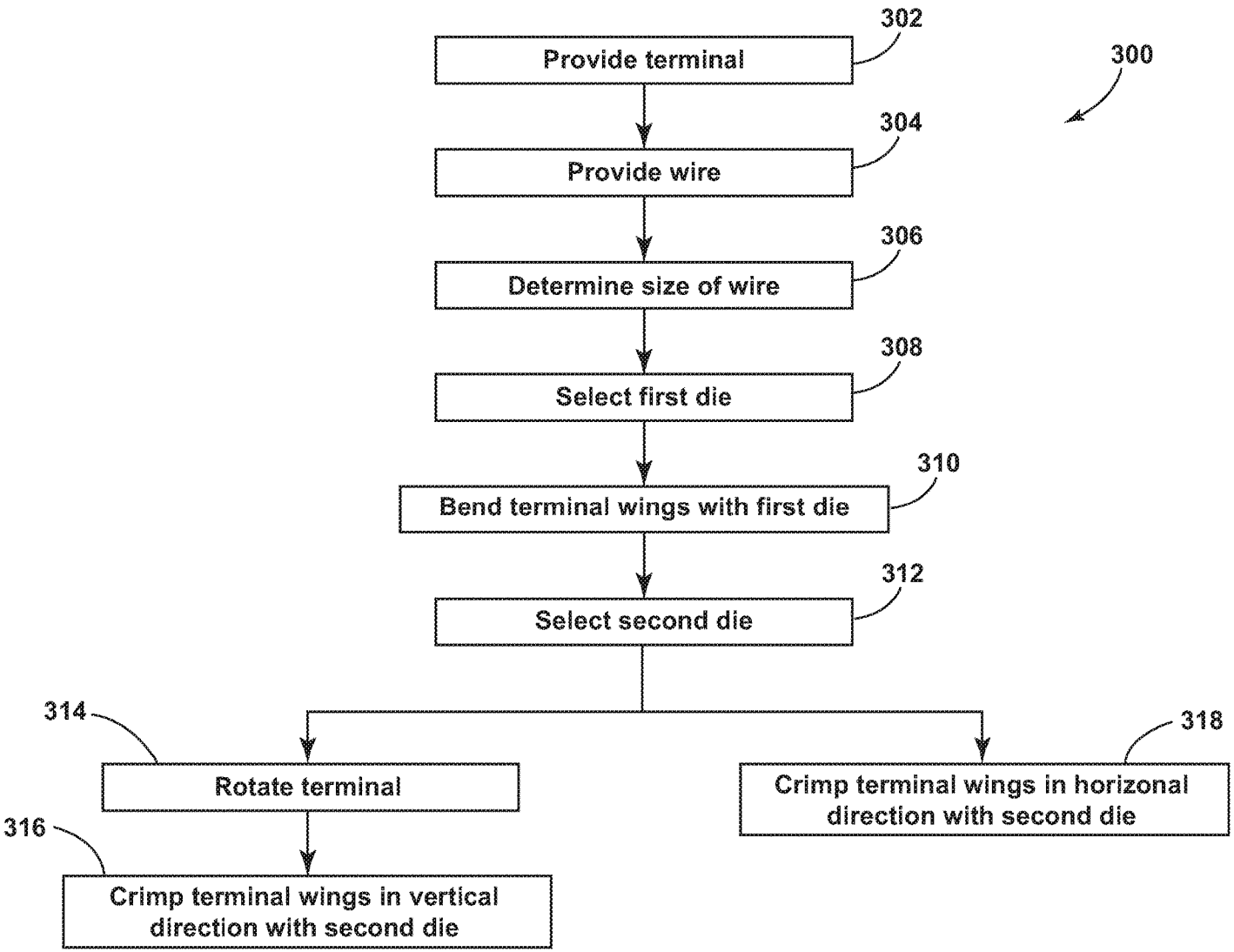
FIG. 2 is a flowchart generally illustrating an embodiment of a method of assembling a terminal assembly.

In embodiments, such as generally illustrated in FIG. 2, a method 300 of assembling a terminal assembly 22 may include providing a terminal 20 (step 302), providing a wire 24 (step 304), determining the size of the wire 24 (step 306), and/or selecting a first/bending die 130 (step 308). The method 300 may include bending one or more of the terminal wings 50, 60, 70, 80 via the first die 130 (step 310), such as in a first direction relative to the terminal assembly 22. The method 300 may include selecting a second/crimping die 170 (step 312) and/or rotating the terminal assembly 22 from a first position to a second position (step 314). The first position of the terminal assembly 22 may be substantially perpendicular relative to the second position of the terminal assembly 22. The method 300 may include crimping the terminal 20 (e.g., the terminal wings 50, 60, 70, 80, and/or the bent portions 190, 192, 194, 196) via the second die 170 (step 316). For example and without limitation, a terminal 20 may be bent while the terminal 20 is in a first position (e.g., a vertical position) and the terminal 20 may be crimped while the terminal 20 is in a second position (e.g., in a horizontal position).

With embodiments, as an alternative to rotating the terminal assembly 22 in step 314, the terminal wings 50, 60, 70, 80 may be crimped in a second direction (relative to the terminal 20). The second direction that may be different from the direction of bending (step 318). For example and without limitation, a terminal 20 may be bent from a first direction (e.g., a vertical direction) and the terminal 20 may be crimped from a second direction (e.g., a horizontal direction).

In embodiments, bending a terminal 20 from a first direction may include moving one or more portions of a bending die 130 in the first direction and crimping the terminal 20 in a second direction may include moving one or more portions of a crimping die 170 in the second direction. If the terminal 20 is rotated, such as in step 314, the first direction and the second direction may be substantially the same and/or parallel (e.g., a terminal 20 may be bent via a vertically-moving bending die 130 and crimped via a vertically-moving crimp die 170). If the terminal 20 is not rotated, the first direction and the second direction may be different and/or not parallel (e.g., may be perpendicular).

With embodiments, crimping one or more of the terminal wings 50, 60, 70, 80 may include crimping the first wing 50 and the second wing 60 with a conductor 26 of the wire 24 and/or crimping the third wing 60 and the fourth wing 80 with the insulator 28 of the wire.

In embodiments, the terminal 20 may include a first state, a second state, and/or a third state. In the first state, the terminal 20 may not be crimped, shortened, altered, and/or bent (see, e.g., FIGS. 1A-1F). In the second state, at least a portion of the terminal 20 may be bent (see, e.g., FIGS. 3C-5C). For example and without limitation, the end portions 58, 68, 78, 88 of the first wing 50, the second wing 60, the third wing 70, and/or the fourth wing 80 may be bent inwards towards a center of the terminal body portion 40. In the third state, the terminal 20 may be crimped onto/with a wire 24 (see, e.g., FIGS. 7A-8C). In embodiments, a first die 130 may be configured to bend a portion of the terminal 20. The terminal 20 may transition from the first state to the second state via the first die 130. A second die 170 may crimp the terminal 20. With embodiments, the terminal 20 may transition from the second state to the third state via the second die 170.

With embodiments, the wings 50, 60, 70, 80 may be bent such that the first channel 100 and/or the second channel 102 remain substantially open. The channels 100, 102 may be substantially open so that a wire 24 may be inserted (e.g., vertically from above the terminal 20 or longitudinally) into the first and/or second channel 100, 102. In a bent state, the inner surfaces of the end portions 58, 68, 78, 88 of the wings 50, 60, 70, 80 may be in contact with the inner surface of the middle portion 56, 66, 76, 86 of the wings 50, 60, 70, 80. For example and without limitation, the entire inner surfaces of the end portions 58, 68, 78, 88 may be in contact with the middle portions 56, 66, 76, 86 and/or the end portions may be substantially parallel with the middle portions 56, 66, 76, 86 (e.g., the end portions 58, 68, 78, 88 may be bent substantially 180 degrees relative to the middle portions 56, 66, 76, 86 and/or the connecting portions 54, 64, 74, 84.

In embodiments, such as generally illustrated in FIGS. 3A, 3B, 3C, 4A, and 4B, a method of bending the terminal 20 may include bending a terminal 20 via a first die 130 (e.g., a bending die). The first die 130 may include a top portion 131 and a bottom portion 132. The top portion 131 may be disposed substantially parallel to the bottom portion 132.

Figure 4B:
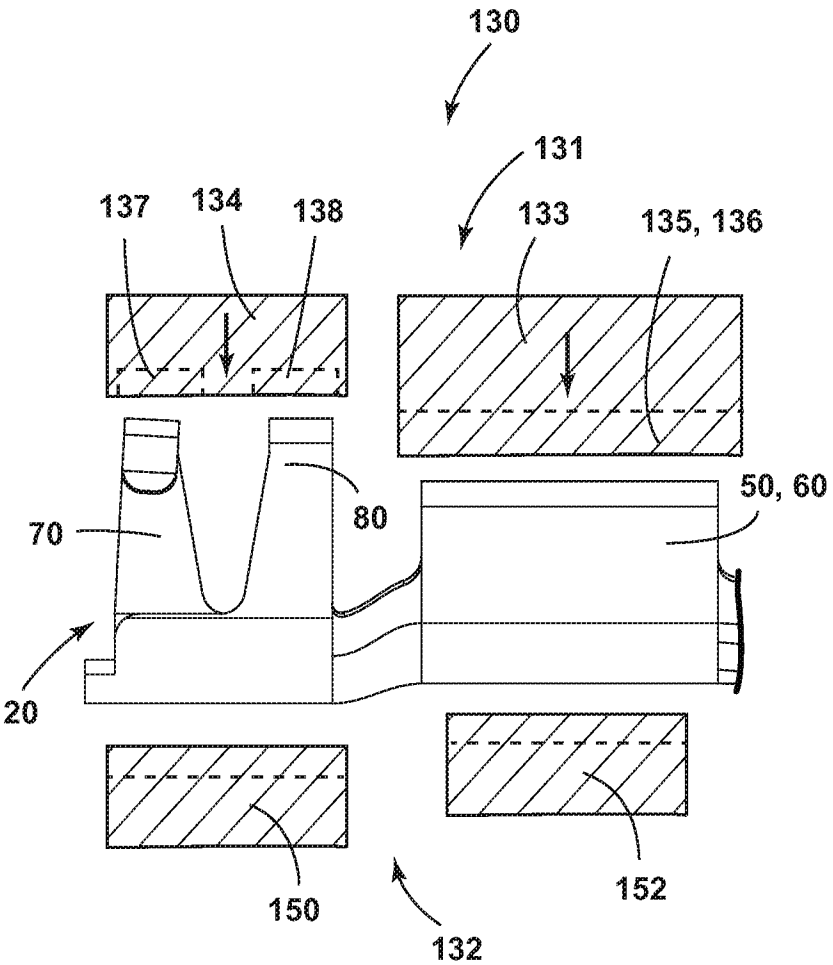
FIGS. 4A and 4B are side views generally illustrating portions of embodiments of terminals and dies.
Figure 4A:
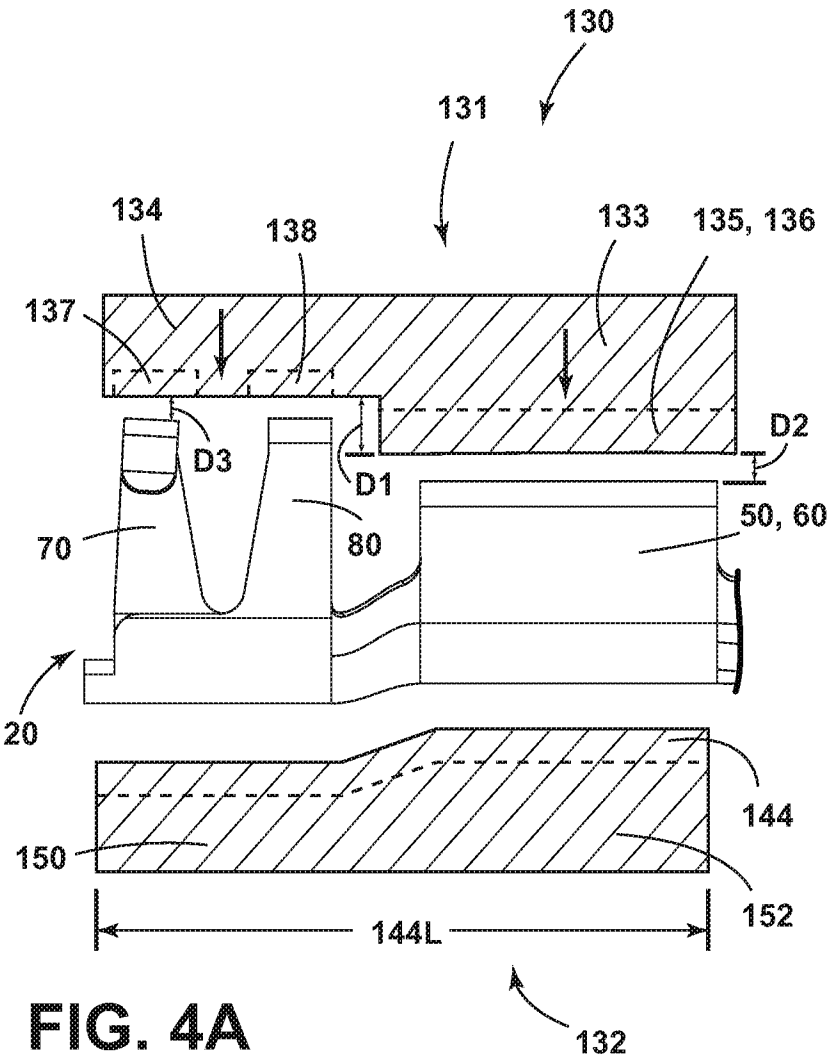
Figure 4C:
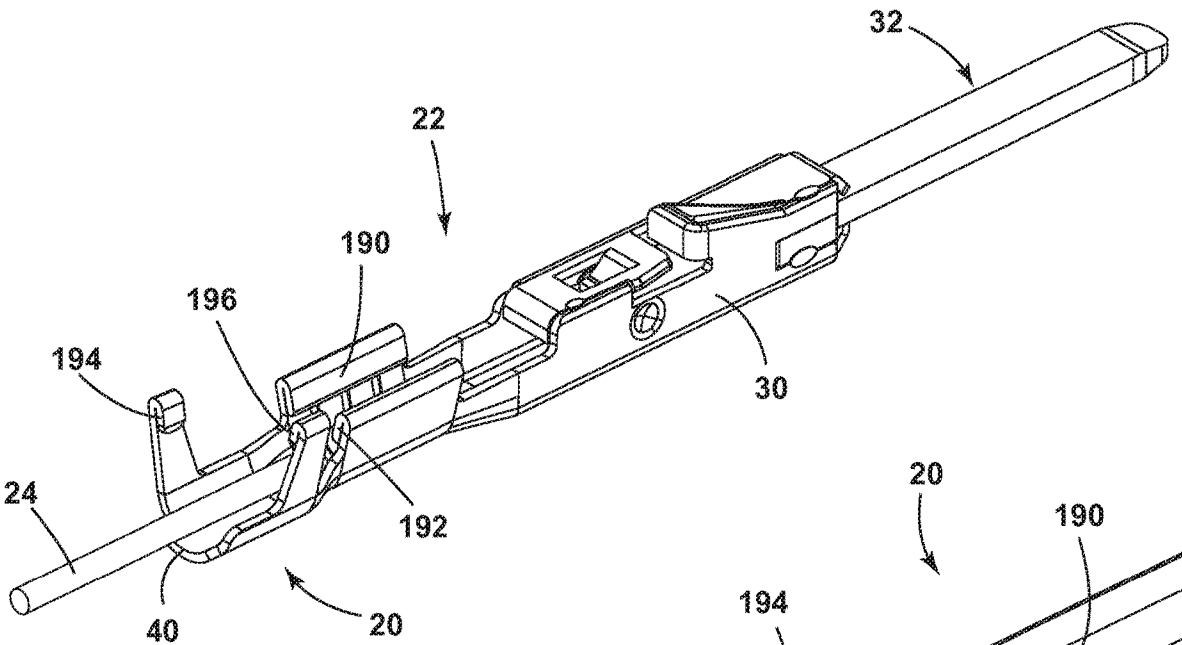
FIG. 4C is a perspective view generally illustrating portions of an embodiment of a terminal assembly after bending.
Figure 4D:
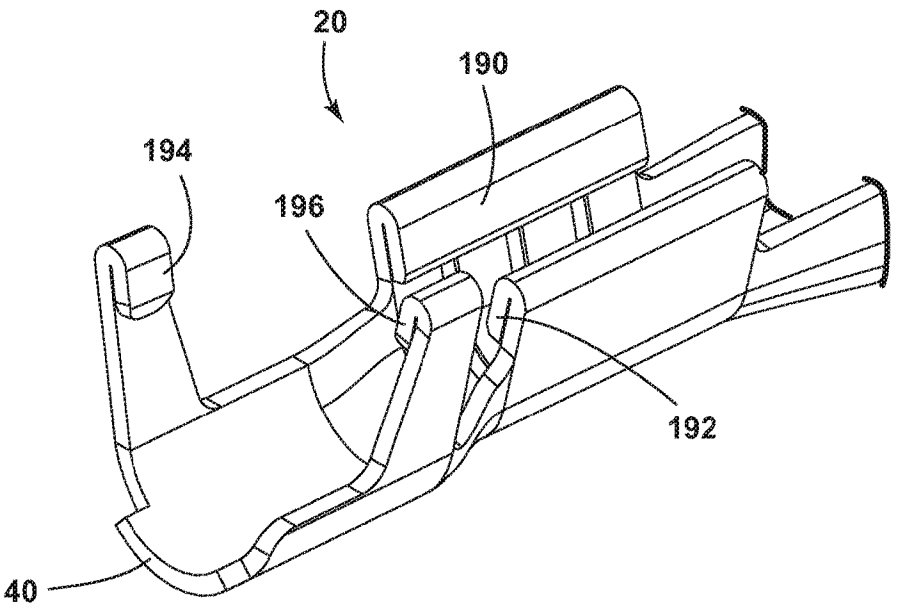
FIG. 4D is a perspective view generally illustrating portions of an embodiment of a terminal after bending.
Figure 4E:
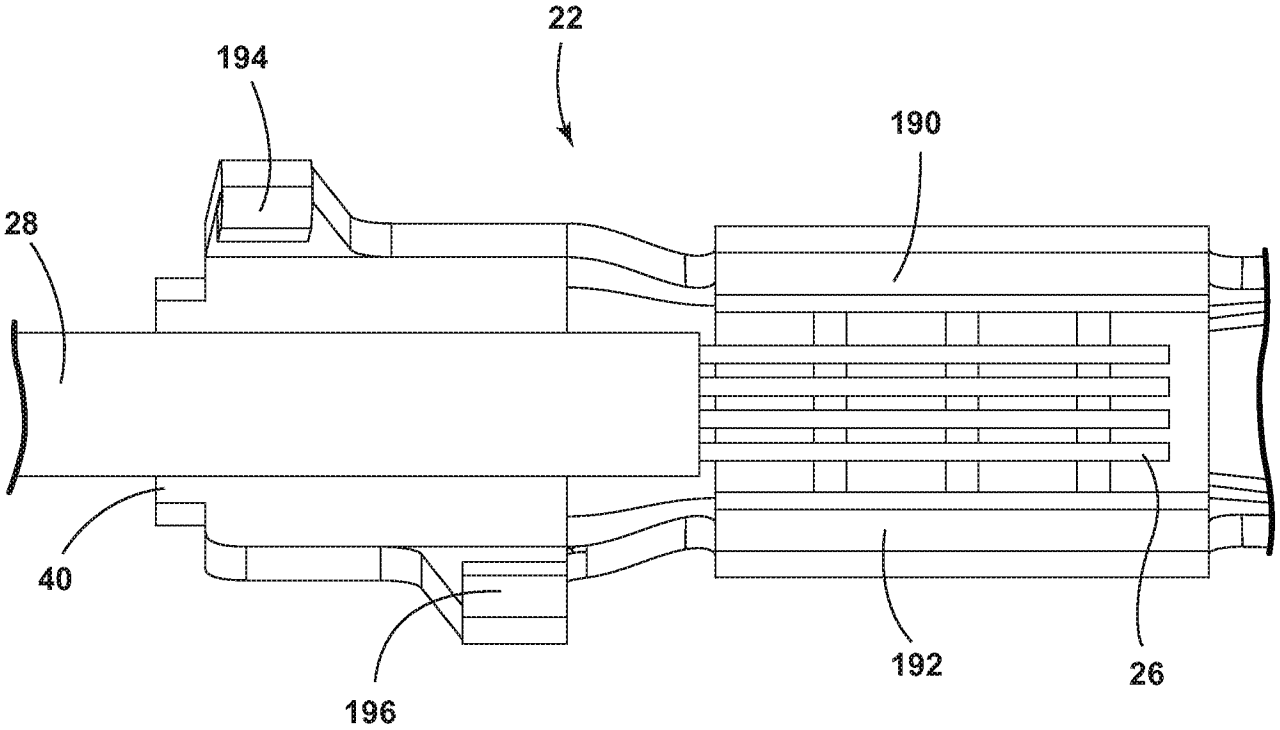
FIG. 4E is a top view generally illustrating portions of an embodiment of a terminal assembly after bending.

With embodiments, the top portion 131 may be disposed proximate the end portions 58, 68, 78, 88 of the wings 50, 60, 70, 80. The bottom portion 132 may be disposed proximate the terminal body portion 40 and/or the connecting portions 54, 64, 74, 84 of the wings 50, 60, 70, 80. In embodiments, the top portion 131 of the first die 130 may include a conductor bending portion 133 and an insulator bending portion 134 (see, e.g., FIGS. 4A and 4B). As generally illustrated in FIG. 4A, the conductor bending portion 133 may be formed with the insulator bending portion 134 as a single piece. Alternatively, as generally illustrated in FIG. 4B, the conductor bending portion 133 may be independent from the insulator bending portion 134 (e.g., the conductor bending portion 133 and the insulator bending portion may be separate pieces that may be independently movable). In embodiments, the conductor bending portion 133 may be configured to bend the first wing 50 and the second wing 60, and/or the insulator bending portion 134 may be configured to bend the third wing 70 and the fourth wing 80. The conductor bending portion 133 may be vertically offset by a distance $D_1$ from the insulator bending portion 134, such as to compensate for different heights of the first wing 50 and the second wing 60 relative to the third wing 70 and the fourth wing 80. In an initial/non-bending position, a conductor bending portion 133 may be disposed at a distance $D_2$ from the first wing 50 and/or the second wing 60. In an initial/non-bending position, the insulator bending portion 134 may be disposed at a distance $D_3$ from the third wing 70 and/or fourth wing 80. Distances $D_2$, $D_3$ may be substantially the same.

With embodiments, a first die top portion 131 may include a first recess 135 and/or a second recess 136. In embodiments, the first recess 135 and/or a second recess 136 may receive at least a portion of the wings 50, 60, 70, 80. The first recess 135 and/or the second recess 136 may include one or more of a variety of shapes, sizes, and/or configurations. For example and without limitation, the first recess 135 and/or a second recess 136 may be substantially oval-shaped and/or generally rounded. The recesses 135, 136 may include a plurality of planar segments (see e.g. FIG. 3B) that may be disposed to form a generally rounded shape (e.g., a half circle-shaped and/or half oval-shaped). A first recess 135 and/or a second recess 136 may open outward and/or to a side of the first die 130. In embodiments, the first recess 135 and the second recess 136 may be configured to bend the end portions 58, 68 of the wings 50, 60 to create bent portions 190, 192.

In embodiments, the first die top portion 131 may include a third recess 137 and/or a fourth recess 138. The third recess 137 and the fourth recess 138 may be configured to bend the end portions 78, 88 of the wings 70, 80 (e.g., simultaneously) to create bent portions 194, 196. With embodiments, the first recess 135 may contact the first wing 50, the second recess 136 may contact the second wing 60, the third recess 137 may contact the third wing 70, and/or the fourth recess 138 may contact the fourth wing 80 (e.g., simultaneously). The recesses 135, 136, 137, 138 may be substantially similar or the same shape and/or size. In embodiments, the first recess 135 and the second recess 136 may be disposed at a different distance from the terminal body portion 40 than the third recess 137 and the fourth recess 138. In embodiments, the first recess 135 and/or the second recess 136 may be formed into the same side (e.g., bottom side) of the top portion 131.

With embodiments, a top portion 131 of a first die 130 may include a first bridge portion 140 and/or a second bridge portion 142. The bridge portions 140, 142 (see, e.g. FIGS. 3A and 3B) may include one or more of a variety of shapes, sizes, and/or configurations. For example and without limitation, the bridge portions 140, 142 may have a substantially flat/planar bottom surface that may include a rectangular configuration or the bottom surface may be substantially pointed. With embodiments, the bridge portions 140, 142 may be disposed between recesses 135, 136, 137, 138. For example, the first bridge portion 140 may be disposed between (e.g., laterally) the first recess 135 and the second recess 136, and/or the second bridge portion 142 may be disposed between the third recess 137 and the fourth recess 138. The bridge portions 140, 142 may limit movement of the wings 50, 60, 70, 80 towards each other and/or the center of the terminal body portion 40 during bending, such as to facilitate insertion of wire 24 into the first channel 100 and/or the second channel 102 after bending and prior to crimping. The first bridge portion 140 may include a width 140W (e.g., in a lateral direction) that may be less than a width 142W (e.g., in a lateral direction) of the second bridge portion 142. For example and without limitation, the widths 140W, 142W of the bridges 140, 142 may correspond to sizes of gaps 230, 240 between the wings 50, 60, 70, 80 (e.g., see FIGS. 5B and 5C). The first gap 230 may be between the bent portions 190, 192 of the first wing 50 and the second wing 60. The second gap 240 may be between the bent portions 194, 196 of the third wing 70 and the fourth wing 80. Greater widths 140W, 142W of the bridges 140, 142 may correlate to larger gaps 230, 240, and/or smaller widths 140W, 142W of the bridges 140, 142 may correlate to smaller gaps 230, 240.

In embodiments, the first die bottom portion 132 may include a channel 144. The channel 144 may include one or more of a variety of shapes, sizes, and/or configurations. For example and without limitation, the channel 144 may be substantially U-shaped, V-shaped, oval-shaped, and/or rounded. In embodiments, the channel 144 may retain a terminal 20 during bending. For example and without limitation, the channel 144 may retain the terminal body portion 40, at least some parts of one or more of the wing connecting portions 54, 64, 74, 84, and/or at least some parts of the middle portions 56, 66, 76, 86. The channel 144 may extend in a longitudinal direction, such as from a first end of the bottom portion 132 to a second end of the bottom portion 132. The first end may be opposite the second end. The channel 144 may include a length 144L (e.g., in the longitudinal direction L) that may be longer or shorter than the terminal 20, or the length 144L may be substantially the same as a length of the terminal 20.

Figure 3C:
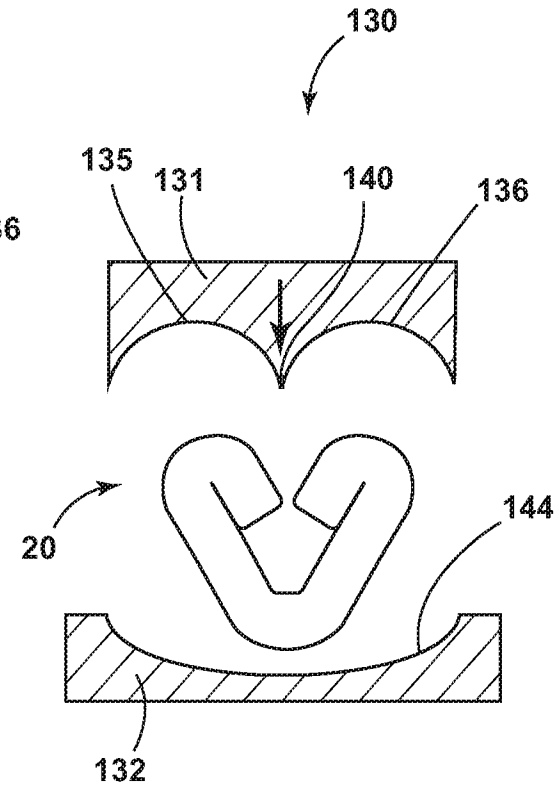
FIGS. 3A, 3B, and 3C are cross-sectional views generally illustrating portions of embodiments of terminals and dies.
Figure 3B:
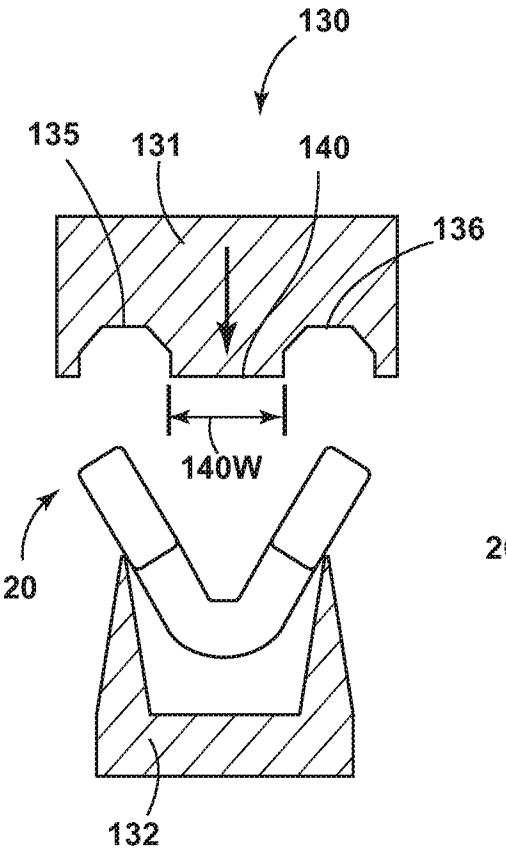
Figure 3A:
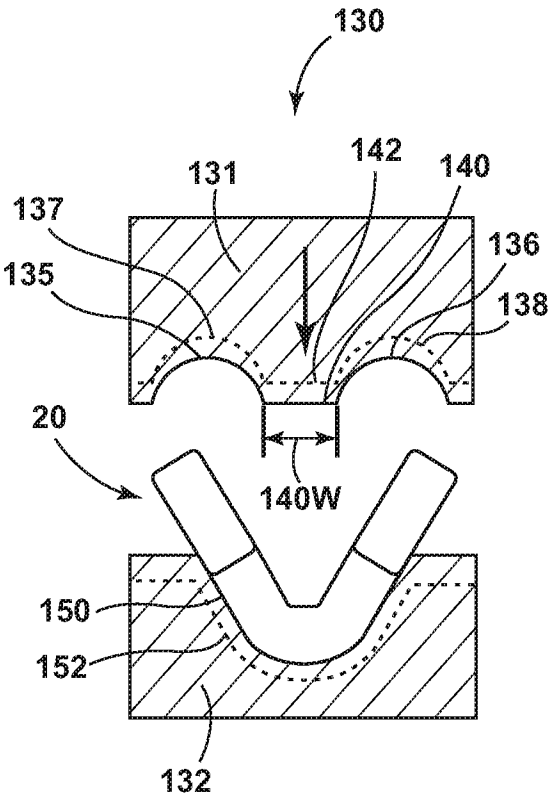

In embodiments, the channel 144 may include an insulator portion 152 and/or a conductor portion 150. The insulator portion 152 may be wider than the conductor portion 150. In embodiments, the insulator portion 152 may be configured to retain (e.g., restrict movement in at least one direction) the terminal body portion 40 at or about the third wing 70 and the fourth wing 80. The conductor portion 150 may be configured to retain the terminal body portion 40 at or about the first wing 50 and the second wing 60. With embodiments, such as generally illustrated in FIG. 3A, in an initial/pre-bending position of the terminal 20, the channel 144 may be configured to contact the terminal 20 along an inner surface of the channel 144 (e.g., substantially all of the inner surface). In other embodiments, such as generally illustrated in FIG. 3B, the channel 144 may be configured to contact the terminal 20 substantially along edges of the channel 144 (e.g., upper edges). In yet other embodiments, such as generally illustrated in FIG. 3C, the channel 144 may be wider than the terminal 20 and the terminal 20 may contact only portions of the inner surface of the channel 144.

In embodiments, such as generally illustrated in FIGS. 4A, 4B, 4C, 4D, 4E, 5A, 5B, and 5C, wings 50, 60, 70 80 may be bent to form bent portions 190, 192, 194, 196. A bending die top portion 131 may be pressed (e.g. in a downward direction) onto the terminal 20, such as while the bending die bottom portion 132 supports the terminal 20 from the opposite direction, to form bent portions 190, 192, 194, 196. The first recess 135 may contact the first wing 50 and/or the first recess 135 may bend the end portion 58 of the first wing 50 to form a first bent portion 190. Bending the first wing 50 may include bending the end portion 58 such that the end portion 58 contacts the middle portion 56 of the first wing 50. With embodiments, the second recess 136 may contact the second wing 60 and/or the second recess 136 may bend the end portion 68 of the second wing 60 to form a second bent portion 192. Bending the second wing 60 may include bending end portion 68 such that end portion 68 contacts the middle portion 66 of the second wing 60. The third recess 137 may contact the third wing 70 and/or the third recess 137 may bend the end portion 78 of the third wing 70 to form a third bent portion 194. Bending the third wing 70 may include bending the end portion 78 such that the end portion 78 contacts the middle portion 76 of the third wing 70. The fourth recess 138 may contact the fourth wing 80 and/or the fourth recess 138 may bend the end portion 88 of the fourth wing 80 to form a fourth bent portion 196. Bending the fourth wing 80 may include bending the end portion 88 such that the end portion 88 contacts the middle portion 86 of the fourth wing 80.

In embodiments, during bending, the end portions 58, 68, 78, 88 may first contact the outer portions of the recesses 135, 136, 137, 138. As the top portion 131 and the bottom portion 132 of the first die 130 move together, the end portions 58, 68, 78, 88 may move from contacting the outer portions to contacting the inner portions of the first recesses 135 136, 137, 138. With embodiments, as the end portions 58, 68, 78, 88 may move from contacting the outer portions to contacting the inner portions, the first die 130 may cause the end portions 58, 68, 78, 88 to bend, resulting in bent portions 190, 192, 194, 196.

With embodiments, the bent portions 190, 192, 194, 196 may include the end portions 58, 68, 78, 88 of the wings 50, 60, 70, 80 contacting the respective middle portions 56, 66, 76, 86 of the wings 50, 60, 70, 80 such that some or all of the inner surfaces of the end portions 58, 68, 78, 88 may be in contact with inner surfaces of the middle portions 56, 66, 76, 86. With embodiments, during bending, the recesses 135, 136, 137, 138 may bend the end portions 58, 68, 78, 88 of the wings 50, 60, 70, 80 substantially 180 degrees such that the end portions 58, 68, 78, 88 are parallel with middle portions 56, 66, 76, 86. In embodiments, the bent portions 190, 192, 194, 196 may or may not include a space between the inner surfaces of the end portions 58, 68, 78, 88 and the middle portions 56, 66, 76, 86.

In embodiments, a third state of the terminal 20 may include the terminal 20 being crimped with a wire or cable, such as after bending. The terminal 20 may be crimped with a wire 24 via a second die 170. The second die 170 may include a top portion 171 and a bottom portion 172. The top portion 171 may be disposed substantially parallel to the bottom portion 172. In embodiments, the first die 130 for bending may also be the second die 170 for crimping. Alternatively, the first die 130 may be a different die than the second die 170.

With embodiments, such as generally illustrated in FIGS. 6A, 6B, 7A, and 7B, the top portion 171 may be disposed proximate the middle portions 56, 76 and/or connecting portions 54, 74 of the wings 50, 70. The bottom portion 172 may be disposed proximate the middle portions 66, 86 and/or the connecting portions 64, 84 of the wings 60, 80. In embodiments, the top portion 171 may include a conductor crimp portion 173 and an insulator crimp portion 174. The conductor crimp portion 173 may be formed with the insulator crimp portion 174 as a single piece. Alternatively, the conductor crimp portion 173 may be independent from the insulator crimp portion 174 (e.g., may be separate, independently movable pieces). The conductor crimp portion 173 may be disposed proximate the second wing 60. The insulator crimp portion 174 may be disposed proximate the third wing 70. A conductor crimp portion 173 may be disposed at a distance $D_4$ from the second wing 60, and the insulator crimp portion 174 may be disposed at a distance $D_5$ from the third wing (see, e.g., FIG. 7B). Distances $D_4$, $D_5$ may or may not be substantially the same.

With embodiments, the conductor crimp portion 173 may include a first recess 175, and/or a second recess 176. The conductor crimp portion 173 may include a first protrusion 200 between the first recess 175 and the second recess 176. The insulator crimp portion 174 may include a third recess 177 and/or a fourth recess 178. The insulator crimp portion 174 may include a second protrusion 202 that may be disposed between the third recess 177 and the fourth recess 178. The first protrusion 200 and the second protrusion 202 may include one or more of a variety of shapes, sizes, and/or configuration. For example and without limitation, the first and second protrusions 200, 202 may be substantially triangle-shaped and/or pointed.

In embodiments, the recesses 175, 176, 177, 178 may include one or more of a variety of shapes, sizes, and/or configurations. For example and without limitation, the recesses 175, 176, 177, 178 may be substantially oval-shaped, half circle-shaped, and/or generally rounded. The recesses 175, 176, 177, 178 may include a plurality of planar segments that may be disposed to form a generally rounded shape (e.g., a similar manner as generally illustrated in connection with first die top portion 131 in FIG. 3B). The recesses 175, 176, 177, 178 may be substantially similar to each other and may include substantially the same shape and/or size. In embodiments, the first recess 175 and the second recess 176 may be disposed at a different distance from the terminal body portion 40 (e.g., at a different height) than the third recess 177 and the fourth recess 178, such as to compensate for different lengths of the first wing 50 and the second wing 60 relative to the third wing 70 and the fourth wing 80. The first recess 175 and the second recess 176 may be disposed at the same distance from the second wing 60 as the third recess 177 and the fourth recess 178 may be disposed from the third wing 70.

In embodiments, such as generally illustrated in FIGS. 6A, 6B, 7A, and 7B, the second die bottom portion 172 may include a channel 180. The channel 180 may include one or more of a variety of shapes, sizes, and/or configurations. For example and without limitation, the channel 180 may be substantially U-shaped, V-shaped, oval-shaped, and/or rounded. In embodiments, the channel 180 may retain a terminal 20 during crimping. For example and without limitation, the channel 180 may retain the terminal body portion 40, the connecting portion 54 of the first wing 50, the middle portion 56 of the first wing 50, and/or the first bent portion 190. Additionally or alternatively, the channel 180 may retain at least a part of the third wing 70 and/or the fourth wing 80. The channel 180 may extend in a longitudinal direction, such as from a first end of the bottom portion 172 to a second end of the bottom portion 172. The first end may be opposite the second end. The channel 180 may include a length 180L (e.g., in the longitudinal direction) that may be longer or shorter than the terminal 20, or the length 180L may be substantially the same as a length of the terminal 20.

Figure 7A:
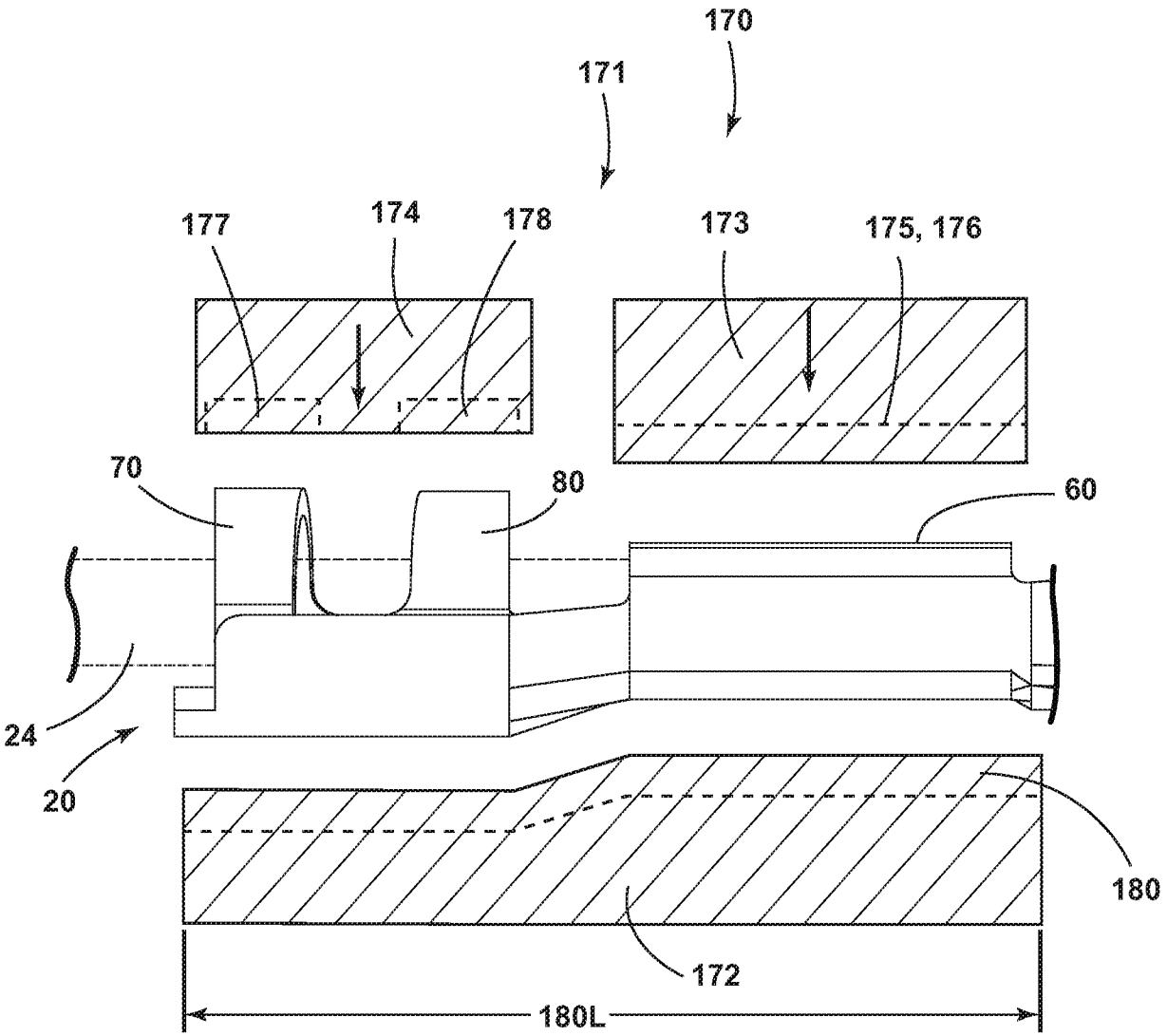
FIGS. 7A and 7B are side views generally illustrating portions of embodiments of terminal assemblies and dies.
Figure 7B:
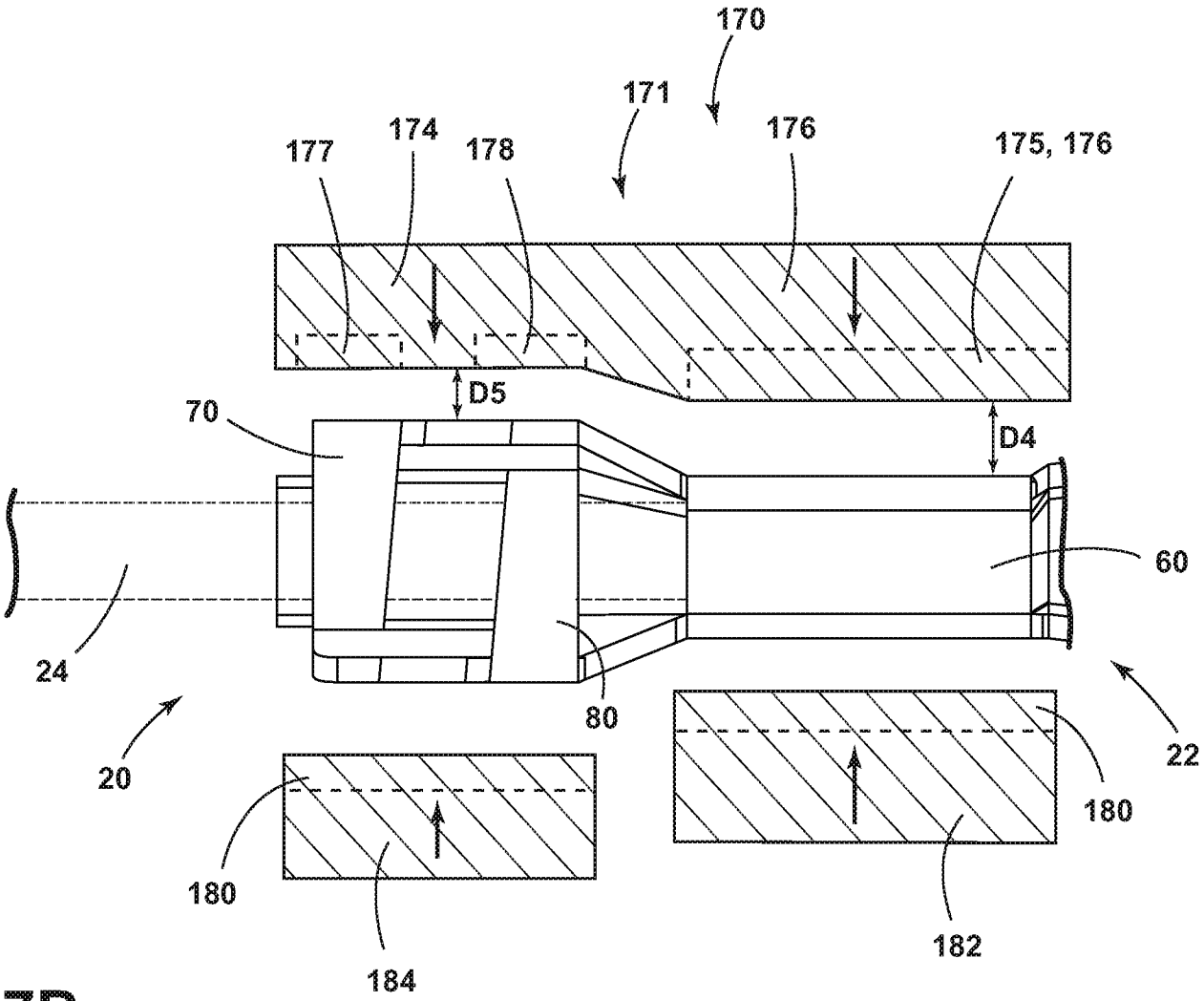

With embodiments, the channel 180 may include an insulator portion 182 and/or a conductor portion 184. The conductor portion 184 may be wider (e.g., in a transverse direction) than the insulator portion 182 in at least some sections. In embodiments, the insulator portion 182 may be configured to retain (e.g., restrict movement in at least one direction) the terminal body portion 40 at or about the third wing 70 and the fourth wing 80. The conductor portion 184 may be configured to retain the terminal body portion 40 at or about the first wing 50 and the second wing 60. With embodiments, such as generally illustrated in FIGS. 7A and 7B, in an initial position (e.g., a post-bending and pre-crimping position) of the terminal 20, the channel 180 may be configured to contact the terminal 20 along an inner surface of the channel 180 (e.g., substantially all of the inner surface). In other embodiments, the channel 180 may be wider than the terminal 20 and the terminal 20 may contact only portions of the inner surface of the channel 180.

In embodiments, such as generally illustrated in FIGS. 3A, 3B, 3C, 6A, and 6B, a terminal assembly 22 may include a first position and a second position. The terminal 20 may be in the first position (see, e.g. FIGS. 3A, 3B, and 3C) during bending and/or the terminal 20 may be in the second position (see, e.g. FIGS. 6A and 6B) during crimping. The second position of the terminal 20 may be rotated substantially 90 degrees from the first position of the terminal 20. The first position may be substantially vertical and/or the second position may be substantially horizontal. In embodiments, the terminal 20 may be bent from a first direction relative to the terminal 20, and/or the terminal 20 may be crimped from a second direction relative to the terminal. The first direction may be substantially perpendicular to the second direction. For example and without limitation, the bending a terminal 20 from a first direction may include bending the terminal 20 from the top and/or the bottom of the terminal 20, and crimping a terminal 20 from a second direction may include crimping the terminal 20 from the left side and/or the right side of the terminal 20.

In embodiments, during crimping, at least one of a second die top portion 171 may be moved, in a second direction into contact with the terminal 20, such as while the second die bottom portion 172 supports the terminal 20 from the opposite direction (or vice versa), to form the crimped terminal 20 (see, e.g. FIGS. 7D, 7E, 8A, 8B, and 8C). The first recess 175 and/or the second recess 176 may contact the second wing 60 to crimp the terminal 20. Crimping the second wing 60 may include bending the second bent portion 192 such that the second bent portion 192 folds inward substantially 180 degrees. The first recess 175 may contact the terminal body 40, the connecting portion 64, and/or the middle portion 66 of the second wing 60. The second recess 176 may contact middle portion 66 and/or the second bent portion 192 of the second wing 60. The first protrusion 200 may contact the middle portion 66 of the second wing 60.

With embodiments, the top portion 171 and the bottom portion 172 of the second die 170 may move together, and the first protrusion 200 may be the first portion of the top portion 171 to contact the terminal 20. The first protrusion 200 may force the middle portion 66 and the second bent portion 192 into the first recess 175, which may cause the second bent portion 192 to fold inwards as the second bent portion 192 moves from an inner portion of the second recess 176 to the outer portion of the second recess 176. The bottom portion 172 of the second die 170 may contact the first wing 50 and/or the terminal body portion 40. In embodiments, the channel 180 may contact only the connecting portion 54 of the first wing 50, the middle portion 56 of the first wing 50, and/or the first bent portion 190 (e.g. may not contact the second wing 60). The second wing 60 of the terminal 20 may be aligned parallel or at an angle to a surface of the bottom portion 172 of the second die 170. In other embodiments, the first bent portion 190 may contact the inner surface of the conductor portion 182, which may cause the first bent portion 190 to fold inwards, such as substantially 180 degrees. In embodiments, the first bent portion 190 may fold more than 180 degrees (e.g., the end portion 58 of the first wing 50 may fold twice for a total of about 360 degrees of bend).

In embodiments, as the top portion 171 and the bottom portion 172 of the second die 170 move together, the terminal 20 may be substantially aligned with the second recess 176 (e.g., the first protrusion 200 may contact the terminal body portion 40 and/or the second bent portion 192 may contact an outer edge of the second recess 176) instead of aligned in a middle of the second die 170. An outer edge of the second recess 176 may apply a downward force to the second bent portion 192, which may cause the second bent portion 192 to fold inwards, such as substantially 180 degrees. In embodiments, the second bent portion 192 may fold more than 180 degrees (e.g., the end portion 68 of the second wing 60 may fold twice for a total of 360 degrees of bend).

Figure 7C:
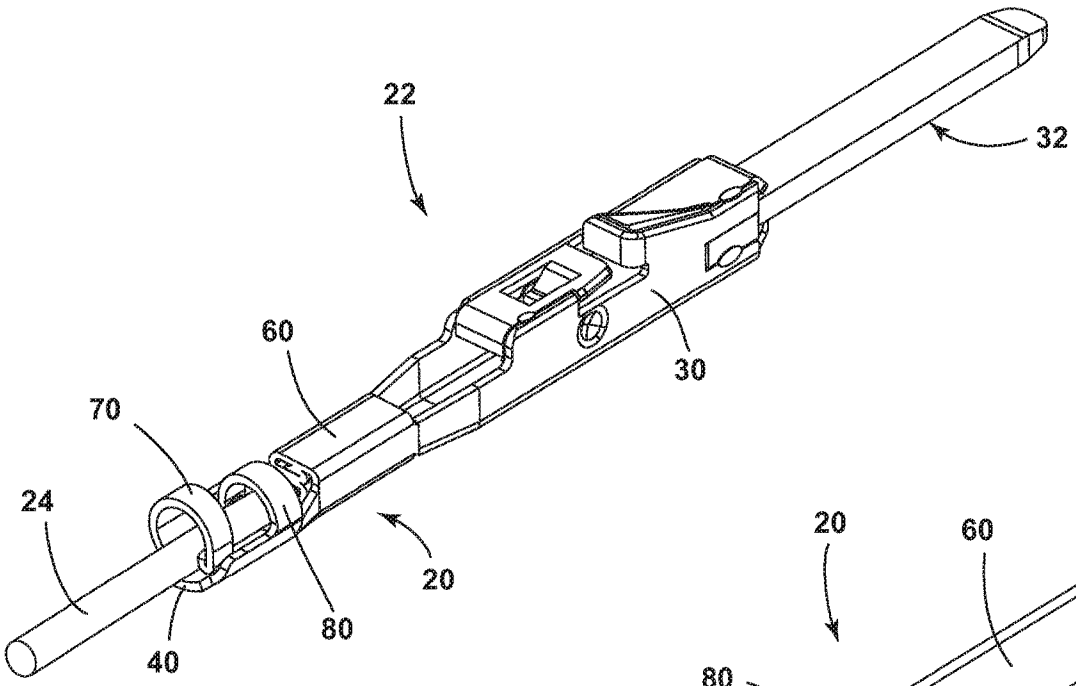
FIG. 7C is a perspective view generally illustrating portions of an embodiment of a terminal assembly after bending and crimping.
Figure 7D:
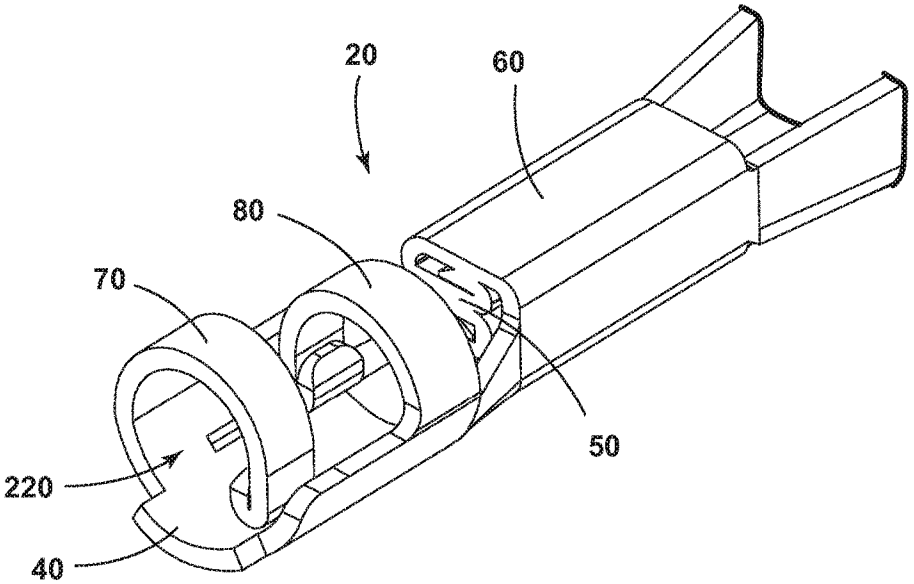
FIG. 7D is a perspective view generally illustrating portions of an embodiment of a terminal after bending and crimping.
Figures 8A, 8B, 8C:
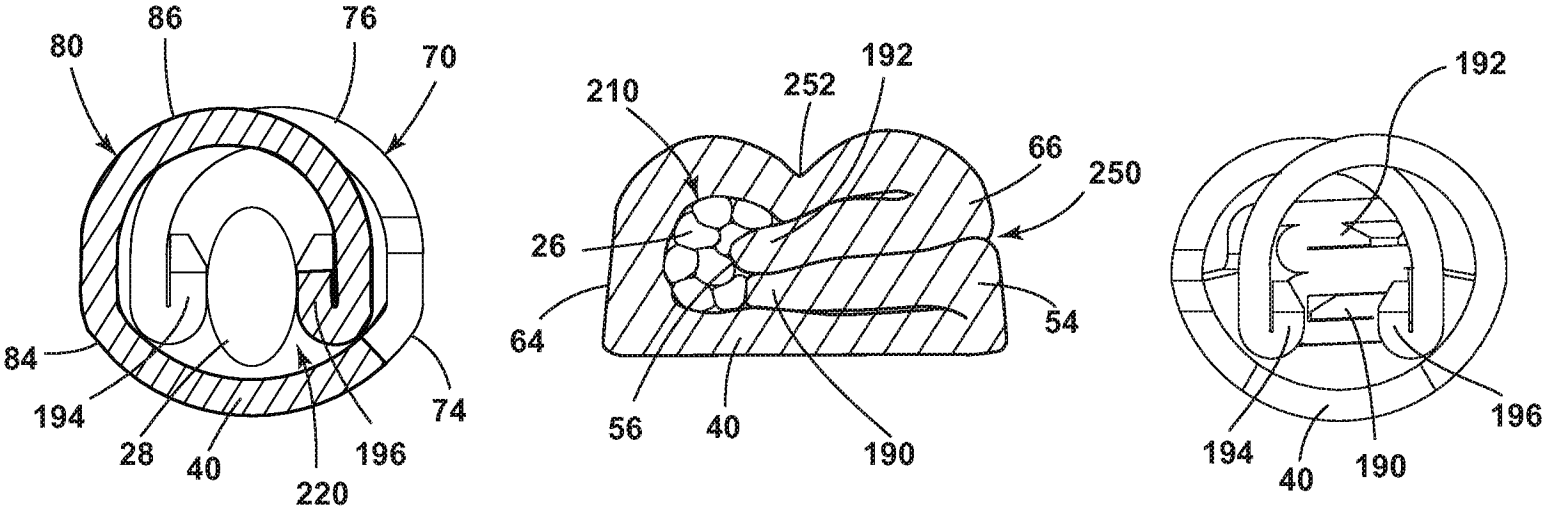
FIGS. 8A and 8B are cross-sectional views generally illustrating embodiments of terminal assemblies after bending and crimping.
FIG. 8C is an end view of a terminal after bending and crimping.

In embodiments, such as generally illustrated in FIGS. 7D, 7E, and 8A, the third wing 70 and/or the fourth wing 80 may be crimped onto an insulator. The third wing 70 and/or fourth wing 80, which may include a third bent portion 194 and a fourth bent portion 196, respectively, may or may not be crimped similarly to the first wing 50 and/or the second wing 60. For example and without limitation, the first wing 50 and the second wing 60 may be crimped while the terminal 20 is in a second/horizontal position, and the third wing 70 and the fourth wing may be crimped while the terminal 20 is in a first/vertical position. Alternatively, the third wing 70 and the fourth wing 80 may be crimped while the terminal 20 is in the second/horizontal position, such as while the first wing 50 and the second wing 60 are being crimped.

With embodiments, after crimping, the third bent portion 194 of the third wing 70 may be disposed closer (e.g., laterally) to a center of the terminal 20 than the connecting portion 84 and/or the middle portion 86 of the fourth wing 80. The fourth bent portion 196 of the fourth wing 80 may be disposed closer to a center of the terminal 20 than the connecting portion 74 and/or middle portion 76 of the fourth wing 80. In embodiments, after crimping, the third and fourth bent portions 194, 196 may contact the terminal body portion 40 and/or the connecting portions 74, 84 (see, e.g., FIG. 8A).

With embodiments, such as generally illustrated in FIGS. 7A, 7B, and 7C, in a third state of a terminal 20, an outer surface of the first bent portion 190 (e.g., an outer surface of the middle portion 56 and/or end portion 58) may be in contact with an inner surface of the connecting portion 54 of the first wing 50 and/or an inside surface of the terminal body portion 40. The outer surface of the second bent portion 192 (e.g., an outer surface of the connecting portion 64, middle portion 66, and/or end portion 68) may be in contact with the inner surface of the middle portion 66 of the second wing 60, the outer surface of the connecting portion 54 of the first wing 50, and/or the outer surface of the middle portion 56 of the first wing 50.

In embodiments, after crimping, an outer surface of the third wing 70 (e.g., an outer surface of the middle portion 76 and/or end portion 78) may or may not be in contact with an outer surface of the fourth wing 80 (e.g., an outer surface of the connecting portion 84, middle portion 86, and/or end portion 88). The third wing 70 and the fourth wing 80 may be offset longitudinally as to not contact each other in the third state of the terminal 20.

In embodiments, a terminal 20 in a third state may include a channel 210 to retain (e.g., restrict movement in at least one direction) a conductor 26 of a wire. The channel 210 may be substantially closed and/or may be formed from the inner surface of the connecting portion 64, the middle portion 66, the outer surface of the second bent portion 192, the outer surface of the middle portion 56, and/or the inner surface of the terminal body portion 40. The channel 210 may include one or more of a variety of shapes, sizes, and/or configurations. For example and without limitation, the channel 210 may be substantially triangular, circular, rectangular, or oval-shaped. The channel 210 may be disposed substantially to a side of the terminal (see, e.g. FIG. 8B in which an example of a channel 210 is generally illustrated on a side of the terminal nearest the second wing 60). In embodiments, the conductor 26 may be in contact with the inner surface of the connecting portion 64, the middle portion 66, the outer surface of the second bent portion 192, the outer surface of the middle portion 56, and/or the inner surface of the terminal body portion 40, some or all of which may provide an electrical connection between the conductor 26 and the terminal 20.

In embodiments, a terminal 20 in a third state may include a channel 220 to retain (e.g., restrict movement in at least one direction) an insulator 28 of a wire 24. The channel 220 may be formed by the terminal body portion 40, the third wing 70, and/or the fourth wing 80. The terminal body portion 40, connecting portions 74, 84, middle portions 76, 86, and/or end portions 78, 88 of the third wing 70 and/or the fourth wing 80 may contact the insulator. With embodiments, only the third bent portion 194, the fourth bent portion 196, and/or the terminal body 40 may contact the insulator 28 (see, e.g., FIG. 8A). The channel 210 retaining the conductor 26 may be aligned with or offset from the channel 220 retaining the insulator 28. For example and without limitation, the channel 210 may be disposed to a side of the terminal 20, such as generally illustrated in FIG.

8B, and the channel 220 may be substantially centered (e.g., laterally) relative to the terminal 20.

With embodiments, such as generally illustrated in FIGS. 8A, 8B, and 8C, after crimping, a terminal 20 may include an external recess 250 that may be disposed at a lateral side of the terminal 20. The external recess 250 may be formed via portions of the first wing 50 and the second wing 60. Additionally or alternatively, after crimping, a terminal 20 may include an external recess 252 that may be disposed in a top side of the terminal 20. The external recess 252 may be formed in an outer surface of the second wing 60 and/or may provide the second wing 60 with a double curve configuration.

Figure 9B:
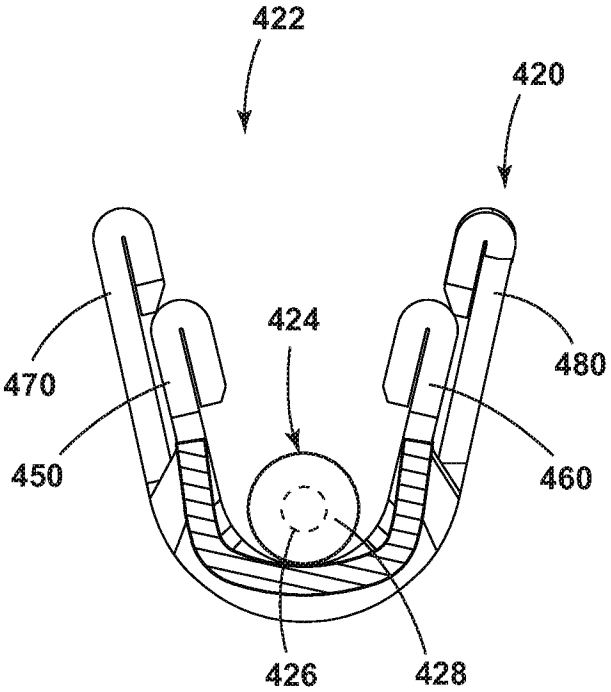
FIGS. 9A and 9B are cross-sectional views generally illustrating embodiments of a first terminal assembly with a first terminal in a bent state and a second terminal assembly with a second terminal in a bent state.
Figure 9A:
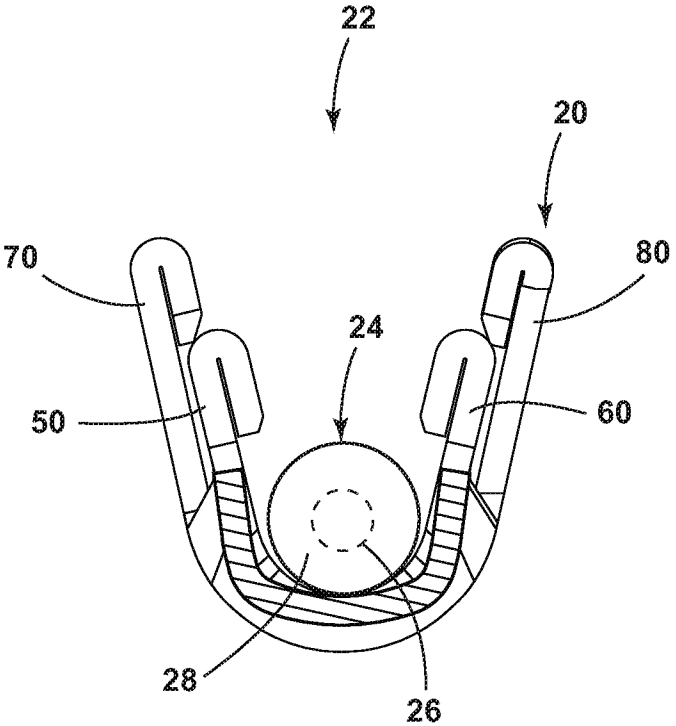

With embodiments, such as generally illustrated in FIGS. 9A and 9B, methods of assembling terminal assemblies may be utilized in connection with wires of different configurations (e.g., sizes, diameters, etc.). A first terminal assembly 22 may include a terminal 20 and a wire 24, and a second terminal assembly 422 may include a second terminal 420 and a second wire 424. The wires 24, 424 may include conductors 26, 426, and/or insulators 28, 428. The second terminal 420 may include a first wing 450, a second wing 460, a third wing 470, and/or a fourth wing 480. In embodiments, a diameter of the wire 24 may be greater than a diameter of the second wire 424. The terminal assembly 22 may be substantially similar to the second terminal assembly 422 and/or include similar features. The length of the first and second wings 50, 450, 60, 460 may be substantially the same. In embodiments, the length of the third and fourth wings 70, 470, 80, 480 may be substantially the same. As the diameter of the second wire 424 is smaller than the diameter of the first wire 24, the wings 450, 460, 470, 480 may be bent to a greater degree than wings 50, 60, 70, 80. For example and without limitation, an effective length of the wings 450, 460, 470, 480 after bending may be shorter than an effective lengths of the wings 50, 60, 70, 80. Bending the wings 450, 460, 470, 480 to a greater degree may facilitate a better crimp connection with the smaller diameter wire 424. The terminal assembly 22 and/or terminal assembly 422 may retain (e.g., restrict movement in at least one direction) wires 24 and/or 424.

With embodiments, bending terminals 20, 420 may permit use of terminals of the same original configuration (pre-bending and pre-crimping), such as terminals 20, 420, with wires/cables of a wide variety of sizes while maintaining sufficient final crimp quality. Bending terminals 20, 420 may limit or prevent separating conductors 26, 426 of the same wire 24, 424 within the terminals 20, 420, during crimping, which may facilitate a better electrical connection between the conductors 26, 426 and the terminal 20, 420. In contrast, using terminals of several different original configurations may complicate assembly, require additional handling processes, and/or involve greater costs, among other issues. In embodiments, crimping the terminal 20 (post-bending) from a side (or from a different direction than bending) may cause a different crimp result than crimping from the top (or from the same direction as bending). The channel 210 of the terminal 20 may be disposed to a side of the terminal 20, and/or may provide for improved electrical connection between the conductors 26 and the terminal 20. The terminal may be used for mechanical connections, and/or the terminal may not be limited to electrical wires.

Various embodiments are described herein for various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments.

Reference throughout the specification to "various embodiments," "with embodiments," "in embodiments," or "an embodiment," or the like, means that a particular feature, structure, or characteristic described in connection with the embodiment is included in at least one embodiment. Thus, appearances of the phrases "in various embodiments," "with embodiments," "in embodiments," or "an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment/example may be combined, in whole or in part, with the features, structures, functions, and/or characteristics of one or more other embodiments/examples without limitation given that such combination is not illogical or non-functional. Moreover, many modifications may be made to adapt a particular situation or material to the teachings of the present disclosure without departing from the scope thereof.

It should be understood that references to a single element are not necessarily so limited and may include one or more of such element. Any directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of embodiments.

Joinder references (e.g., attached, coupled, connected, and the like) are to be construed broadly and may include intermediate members between a connection of elements and relative movement between elements. As such, joinder references do not necessarily imply that two elements are directly connected/coupled and in fixed relation to each other. The use of "e.g." in the specification is to be construed broadly and is used to provide non-limiting examples of embodiments of the disclosure, and the disclosure is not limited to such examples. Uses of "and" and "or" are to be construed broadly (e.g., to be treated as "and/or"). For example and without limitation, uses of "and" do not necessarily require all elements or features listed, and uses of "or" are intended to be inclusive unless such a construction would be illogical.

While processes, systems, and methods may be described herein in connection with one or more steps in a particular sequence, it should be understood that such methods may be practiced with the steps in a different order, with certain steps performed simultaneously, with additional steps, and/or with certain described steps omitted.

It is intended that all matter contained in the above description or shown in the accompanying drawings shall be interpreted as illustrative only and not limiting. Changes in detail or structure may be made without departing from the present disclosure.

What is claimed is:

1. A method of assembling a terminal assembly, the method comprising:

providing a terminal, the terminal including:

a terminal body portion, a first wing including an end portion, and a second wing including an end portion;

bending the end portion of the first wing and the end portion of the second wing to provide a first bent portion and a second bent portion; and crimping the first bent portion and the second bent portion onto a wire;

wherein the terminal is in a first position during bending; the terminal is rotated to a second position after bending; and the terminal is in the second position during crimping.

2. The method of claim 1, wherein the first wing and the second wing are crimped into contact with a conductor of the wire.

3. The method of claim 2, wherein the first position and the second position are substantially perpendicular relative to each other.

4. The method of claim 1, wherein bending the end portion of the first wing and the end portion of the second wing includes bending the end portion of the first wing and the end portion of the second wing via a bending die.

5. The method of claim 1, wherein bending the end portion of the first wing and the end portion of the second wing includes moving at least a portion of a bending die in a first direction; crimping includes moving at least a portion of a crimping die in a second direction; and the first direction and the second direction are substantially parallel.

6. The method of claim 1, wherein the first wing is disposed laterally opposite the second wing; after crimping, the terminal includes an external recess disposed at a lateral side of the terminal; and the external recess is formed via portions of the first wing and the second wing.

7. A method of assembling a terminal assembly, the method comprising:

providing a terminal, the terminal including:

a terminal body, a first wing including an end portion, and a second wing including an end portion, bending the end portion of the first wing from a first direction, relative to the terminal, to provide a first bent portion;

bending the end portion of the second wing from the first direction, to provide a second bent portion; and crimping the first bent portion and the second bent portion with a wire from a second direction relative to the terminal;

wherein crimping the first bent portion and the second bent portion includes a crimping die top portion contacting the first wing and not the second wing.

8. The method of claim 7, wherein the first direction is substantially perpendicular to the second direction.

9. The method of claim 7, wherein bending the end portion of the first wing includes a bending die contacting the end portion of the first wing, and bending the end portion of the second wing includes the bending die contacting the end portion of the second wing.

10. The method of claim 1, wherein crimping the first bent portion and the second bent portion includes a crimp die top portion contacting the first wing and not the second wing.

11. The method of claim 7, wherein crimping the first bent portion and the second bent portion includes a securing channel of a crimp die bottom portion contacting the second wing and not the first wing.

12. The method of claim 7, including crimping a third wing and a fourth wing of the terminal; wherein the third wing and the fourth wing are crimped from a different direction, relative to the terminal, than the first bent portion and the second bent portion.

13. The method of claim 7, wherein after crimping, the terminal includes a section having at least six overlapping layers; the first wing includes at least three overlapping layers of the at least six overlapping layers; and the second wing includes at least three other layers of the at least six overlapping layers.

14. The method of claim 7, wherein, after crimping, the terminal includes an external recess disposed at a lateral side of the terminal; the external recess is formed via portions of the first wing and the second wing; and the first wing and the second wing are configured to contact a conductor.

15. An electrical assembly comprising:

an electrical wire, a terminal body, and a plurality of wings including a first wing and a second wing, wherein the first wing includes a first bent portion; the second wing includes a second bent portion; and the first bent portion is disposed directly below the second bent portion such that the first bent portion and the second bent portion overlap in a vertical direction.

16. The electrical assembly of claim 15, wherein at least one of the first bent portion and the first wing are substantially horizontal; and the terminal body is substantially horizontal.

17. The electrical assembly of claim 16, wherein at least one of the second bent portion and the second wing are substantially horizontal.

18. The electrical assembly of claim 15, including a terminal comprising the terminal body and the plurality of wings; wherein the terminal includes a first external recess disposed at a lateral side of the terminal and formed via portions of the first wing and the second wing; and the terminal includes a second external recess formed at a top side of the terminal in an outer surface of the second wing.

19. The electrical assembly of claim 17, wherein the plurality of wings includes a third wing and a fourth wing; the third wing having a third bent portion and the fourth wing having a fourth bent portion; and wherein the third bent portion and the fourth bent portion are substantially vertical.

20. The electrical assembly of claim 19, wherein the first bent portion and the second bent portion are substantially perpendicular to the third bent portion and the fourth bent portion.

* * * * *